US007186493B2

(12) United States Patent
Yamane et al.

(10) Patent No.: US 7,186,493 B2
(45) **Date of Patent: *Mar. 6, 2007**

(54) ELECTROSTATIC IMAGE DEVELOPING TONER AND TWO-COMPONENT DEVELOPING AGENT

(75) Inventors: Kenji Yamane, Sagamihara (JP); Ken Ohmura, Hachioji (JP); Yasuko Yamauchi, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 177 days.

This patent is subject to a terminal disclaimer.

(21) Appl. No.: 10/806,013

(22) Filed: Mar. 22, 2004

(65) Prior Publication Data

US 2004/0197692 A1 Oct. 7, 2004

(30) Foreign Application Priority Data

Mar. 31, 2003 (JP) ..... 2003-093894

(51) Int. Cl.
*G03G 9/06* (2006.01)

(52) U.S. Cl. ..... 430/108.6; 430/110.1; 430/110.3; 430/110.2

(58) Field of Classification Search ..... 430/108.6, 430/110.1, 110.3, 110.2
See application file for complete search history.

(56) References Cited

U.S. PATENT DOCUMENTS

| | | | | |
|---|---|---|---|---|
| 6,187,497 | B1 * | 2/2001 | Kushi et al. | 430/110.4 |
| 6,921,619 | B2 * | 7/2005 | Ohmura et al. | 430/110.1 |
| 2003/0134217 | A1 * | 7/2003 | Combes et al. | 430/108.11 |

FOREIGN PATENT DOCUMENTS

| | | |
|---|---|---|
| JP | 2000-214629 | 8/2000 |
| JP | 2002-66820 | 3/2001 |
| JP | 2002-132015 | 5/2002 |
| JP | 2002-148848 | 5/2002 |
| JP | 2002-287410 | 10/2002 |

* cited by examiner

*Primary Examiner*—John L Goodrow
(74) *Attorney, Agent, or Firm*—Lucas & Mercanti, LLP

(57) ABSTRACT

A toner for developing an electrostatic image is disclosed. The toner comprises toner particles comprising a resin and a colorant, and the toner comprises metal oxide particles have a domain-matrix structure comprising a domain and a matrix.

16 Claims, 5 Drawing Sheets

TONER HAVING NO CORNERS

TONER HAVING CORNERS

TONER HAVING CORNERS

ELECTROSTATIC IMAGE DEVELOPING TONER AND TWO-COMPONENT DEVELOPING AGENT

BACKGROUND OF THE INVENTION

The present invention relates to an electrostatic image developing toner and a two-component developing agent.

Heretofore, from the viewpoint of simplicity, a dry development system, using a magnetic brush, has commonly been employed as an image forming method of electrophotographic systems using an electrostatic image developing toner. Further, currently, in electrophotographic methods, development of smaller-sized higher speed color printers resulting in higher image quality has become increasingly competitive In order to decrease the overall size of color printers, a so-called cleanerless process (refer, for example, to Patent Document 1) has been developed which makes it possible to remove a cleaner unit utilizing newly developed charging and development bias by designing a simpler and more compact transfer unit.

To overcome the aforesaid problems for apparatuses, at present, toner, having a narrow size and shape distribution, which is represented by polymerization method toners, has received increasing attention (refer, for example, to Patent Document 2).

When such a polymerization method toner is used, a decrease in the overall size of apparatuses is easily achieved. In addition, another beneficial is markedly improved image quality due to its high transferability, since the charge of the toner particles is uniform.

On the other hand, manufacturers who use external additives at a relatively large particle diameter are increasing (refer to, for example, Patent Document 3). The objective of the use of large diameter (hereinafter also referred to as large particle diameter) external additives is to stabilize development as well as to result in high transferability.

Consequently, a technique is disclosed (refer, for example, to Patent Document 4) in which a technique to enhance each toner transferability employing the aforesaid polymerization toner is combined with a technique to enhance the same employing the large diameter external additive. However, when conventional large diameter external additives known in the art are added to the polymerization toner, problems occur in which the aforesaid external additives tend to be released from toner particles due to weak adhesion to toner particles.

As one of the reasons for this release, it is assumed that polymerization toner particles are not capable of electrostatically strongly attract the external additives due to the absence of corners as well as the uniform area charge density on the particle surface.

Further, problems caused by the release of the external additives from toner particles include the following:

(a) For example, in the case of a two-component developing agent, external additives tend to be transferred to the carrier and the development rollers fitted with frictional electrification providing members, resulting in staining. Consequently, frictional electrification is hindered to tend to result in insufficient charging, whereby the working life of developing agents as well as development units deteriorates.

(b) Released external additives are stuck into the photoreceptor surface and toner particles are brought into contact with the resulting stuck portions on the photoreceptor surface to result in deposition and adhesion of the toner. Electric potential on the toner adhered portions does not decrease, whereby white spots, as called in this industry, result.

(c) Charging units are stained and tend to result in insufficient charging. As a result, halftone white streaking as called in this industry is generated.

In order to enhance the adhesion strength of external additives to toner particles, large diameter silica particles (refer, for example, to Patent Document 3) is effectively employed. However, the use of the large diameter silica particles results in problems in which the charge amount of the toner increases due to its high negative chargeability. Further, the large diameter silica particles, exhibiting high negative chargeability, assure improved transferability. However, when combined with a relatively small diameter photoreceptor, problems occur in which peeling discharge tends to occur during separation, whereby unevenness in halftone tends to occur due to discharge (in the industry, it is often called transfer repellency). These problems were particularly pronounced at low humidity.

In order to overcome the aforesaid two drawbacks, the inventors of the present invention experimented (refer to, for example, Patent Documents 5 and 6) to form a structure such that large diameter external additives are subjected to capsulation (for example, those covered with metal oxides of different compositions). However, it was not possible to sufficiently enhance the adhesion and to sufficiently overcome the transfer repellency problems.

(Patent Document 1)
Japanese Patent Publication Open to Public Inspection (herein after referred to as JP-A) No. 2002-132015

(Patent Document 2)
JP-A No. 2000-214629

(Patent Document 3)
JP-A No. 2001-66820

(Patent Document 4)
JP-A No. 2002-287410

(Patent Document 5)
JP-A No. 2002-148848

(Patent Document 6)
JP-A No. 7-89721

SUMMARY OF THE INVENTION

An objective of the present invention is to provide an electrostatic image developing toner, a two-component developing agent, an image forming method, and an electrophotographic image forming apparatus which result in high transferability, high adaptability for a cleaner process, no abrasion on the receptor surface (resulting in no white spots), no staining on the carrier, the development roller, and the charging unit, and no generation of toner blisters.

The present invention and its embodiments will now be described.

1. A toner for developing an electrostatic image comprising toner particles and metal oxide particles, wherein the toner particles comprises a first resin and a colorant, and the metal oxide particles have a domain and a matrix.
2. The electrostatic image developing toner, described in 1. above, wherein the domain comprises titanium oxide and the matrix comprises silica.
3. The electrostatic image developing toner, described in 1. or 2. above, wherein the domain comprises titanium oxide or aluminum oxide and the matrix comprises silica.

4. The electrostatic image developing toner, described in any one of 1.–3. above, wherein the domain and the metal oxide particles are substantially spherical.
5. The electrostatic image developing toner, described in any one of 1.–4. above, wherein the ratio (B/A) of average primary particle diameter A of the metal oxide particles to the average primary particle diameter B of the domain is 0.05–0.4.
6. The electrostatic image developing toner, described in 5. above, wherein the number average primary particle diameter of the metal oxide particles is 20–300 nm and the number average FERE horizontal diameter of the domain is 1–60 nm.
7. The electrostatic image developing toner, described in any one of 1.–6. above, wherein the weight ratio (Y/X) of weight X of metal oxide particles to weight Y of the domain is 0.1–0.6.
8. The electrostatic image developing toner, described in any one of 1.–7. above, wherein a moisture content of the metal oxide particles is at most 2 percent by weight.
9. The electrostatic image developing toner, described in any one of 1.–8. above, wherein among toner particles, the ratio of toner particles without corners is at least 50 percent by number and the number variation coefficient of the number particle size distribution is at most 27 percent.
10. The electrostatic image developing toner, described in any one of 1.–9. above, wherein the toner particles have a covering layer comprising a second resin whose composition is different from the composition of the first resin.
11. The electrostatic image developing toner, described in any one of 1.–10. above, wherein a surface of the toner particles is modified with a third resin whose composition is different from a composition of the first resin.
12. A two-component developing agent comprising the toner described in any one of 1.–11. above and a carrier.

The metal oxide particles are preferably subjected to a hydrophobic treatment.

The toner particles are subjected to either encapsulation or surface modification, employing resinous compositions which are different from each other.

DETAILED DESCRIPTION OF THE INVENTION

Figure 1:
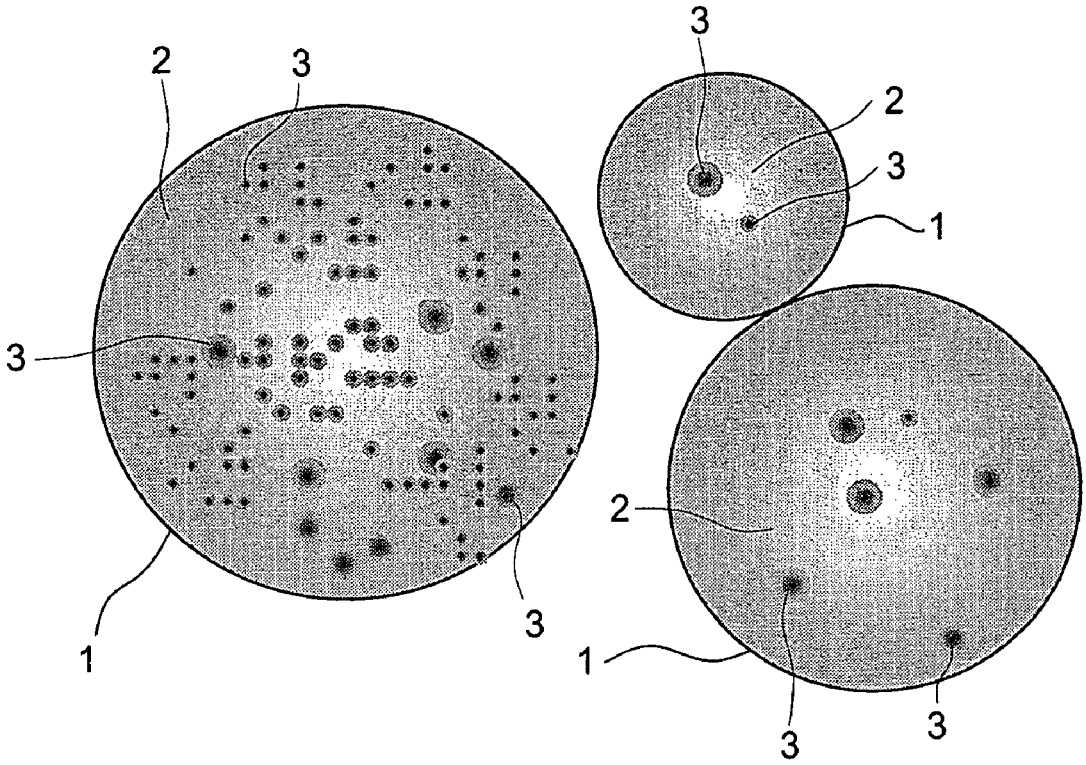
FIG. 1 is one example of the projected view of metal oxide particles comprised of a domain-matrix structure.

The present invention will now be detailed.

The inventors of the present invention discovered that in an electrostatic image developing toner comprised of toner particles comprising at least a resin and a colorant, the electrostatic image developing toner, in which the aforesaid toner particles are comprised of metal oxide particles which are in a domain-matrix structure, exhibits the effects of the present invention, namely excellent effects such as high transferability, high adaptability for a cleaner process, no abrasion on the photoreceptor surface (resulting in no white spots), no staining of the carrier, development rollers and charging units, and no generation of toner blisters.

Preferable examples of the aforesaid domain-matrix structure include one in which the domain is titanium oxide and the matrix is a silicon compound, and another in which the domain is either zirconium oxide or aluminum oxide and the matrix is preferably silica. Further, the silica in the matrix is preferably amorphous.

When, as one of the examples of metal oxide particles having a domain-matrix structure, particles in which the domain comprises titanium compounds and the matrix comprises silica were employed as an external additive, it was discovered that it was possible to solve various problems (problems such as an increase in the charge amount of the toner due to high negative chargeability, and the tendency of formation of unevenness in the halftone due to generation of peeling discharge during separation when large diameter silica at a high negative chargeability, though it enhanced transferability, was combined with a photoreceptor at a relatively small diameter), which occurred when using large diameter silica particles which are one example of conventional large diameter external additive known in the art.

Metal oxide particles having a domain-matrix structure are preferably large diameter external additives. The mechanism is not fully understood, however, based on the fact that control of the domain diameter exhibits specifically high correlation with the performance of transfer repellency, it is assumed that metal oxides which differ in resistance and dielectric constant are not subjected to homogenization at the atomic level, but the balance between the retention and the leakage of charge in particles is optimized while a domain having a definite electrostatic capacity is formed and particles are apart from each other, maintaining a suitable distance.

<<Metal Oxide Particles Comprised of a Domain-Matrix Structure>>

Metal oxide particles comprised of a domain-matrix structure will now be described.

(Domain-Matrix Structure)

Metal oxide particles comprised of a domain-matrix structure are described with reference to FIG. 1.

The domain-matrix structure, as described herein, is also called a sea-island structure. As shown in FIG. 1, the sea-island structure refers to a structure in which island-shaped phases having a closed interface (being an interface between phases) exists in a continuous phase (the continuous phase is a matrix which is a region representing the sea).

In FIG. 1, numeral 1 is a metal oxide particle; numeral 2 is a matrix which is a continuous phase region; and numeral 3 is a domain.

Metal oxide particles are not compatible with each other and each of them comprises constitution components which form independent phases (being a domain and a matrix), and one forms islands and the other forms a sea, whereby metal oxide particles having the domain-matrix structure are formed.

(Observation of Domain-Matrix Structure)

The domain-matrix structure can be confirmed when particles are observed employing an FE-TEM (a field emission type transmission electron microscope) and the mapping of the targeted element is carried out.

(FERE Horizontal Diameter and Metal Oxide Particle Diameter)

The diameter of metal oxide particles having the domain-matrix structure and the FERE horizontal diameter of the domain are determined employing a commercially available image analyzer such as Lusex F (manufactured by Nicolet Japan Corp.).

FERE horizontal diameter, as described herein, refers to the length, in the horizontal direction, of the particle which is placed on a plane in an arbitrary state. The FERE horizontal diameter of the domain refers to the length, in the horizontal direction, of each domain which exists in the interior of the metal oxide particle, arbitrarily placed as above.

The number based average diameter of the primary metal oxide particles is preferably 20–300 nm, is more preferably 35–180 nm, and is most preferably 60–140 nm.

Further, the number based average FERE horizontal diameter of domains is preferably 1–60 nm, is more preferably 2–60 nm, and is most preferably 4–20 nm.

Still further, the ratio (B/A) of the number based average primary particle diameter A of metal oxide particles to the number based average FERE horizontal diameter B of the domains is preferably 0.02–0.4, and is more preferably 0.06–0.2.

Metal Oxides Constituting a Domain and a Matrix

Examples of metal elements used in metal oxides having a domain-matrix structure include aluminum, silicon, manganese, niobium, zirconium, titanium, magnesium, and iron. Of these, preferred as the domain, is titanium, zirconium, or aluminum, while preferred as the matrix is silica.

(Substantially Spherical)

In the present invention, it is preferable that both the domain and the metal oxide particles having the domain-matrix structure are substantially spherical.

"Substantially spherical", as described herein, refers to the case in which the shape factor which is calculated by the image analyzer described below and represented by the formula below is preferably 1.0–1.1.

(Formula)

$$\text{Shape factor}=\{(\text{maximum diameter}/2)^2\times\pi\}/\text{projected area}$$

wherein the maximum diameter refers to the width of the particle which maximizes the distance between the parallel lines when the projected image of a toner particle on a plane is interposed by parallel lines. The projected area refers to the area of a toner projected onto a plane. The shape factor is obtained as follows. A photograph of toner particles at a magnification of 2,000 is prepared employing a scanning type electron microscope. Subsequently, the resulting photograph is subjected to photographic image analysis employing a "Scanning Image Analyzer" (manufactured by JEOL Co.). During this operation, the shape factor is averaged by measuring 100 toner particles.

(Weight Ratio of Domain to Metal Oxide Particles)

The weight percent of the domain which exists in the aforesaid metal oxide particle is preferably 10–60 percent by weight, is more preferably 15–45, and is most preferably 20–40.

The weight percent of the domain in the metal oxides is calculated as follows. The ratio of the metal element in the domain to the metal element constituting the matrix is determined employing a commercially available fluorescent X-ray analyzer, and subsequently the desired weight percent is calculated.

For example, when the domain is titanium oxide ($TiO_2$) and the matrix is silica ($SiO_2$), element analysis is carried out employing X-rays while paying attention to Ti in the domain and Si in the matrix. Obtained results are converted to the $TiO_2$ amount and the $SiO_2$ amount, respectively, and calculation is carried out employing the formula described below.

$$(TiO_2)/(TiO_2+SiO_2)\times 100 \text{ (weight percent)}$$

Hydrophobic Treatment of Metal Oxide Particles and Hydrophobic Treatment of Metal Oxide Particles and Specification of Moisture Content In the present invention, it is preferable that metal oxide particles are subjected to a hydrophobic treatment. The moisture content of the metal oxide particles is preferably at most 2 percent, and is more preferably 0.1–1.5 percent.

It is preferable that metal oxide particles are subjected to a hydrophobic treatment employing hydrophobicity promoting agents.

Employed as methods to promote metal oxide particles with hydrophobicity may be either a dry process method or a wet process method. However, in view of stabilizing chargeability, the dry process method is preferable.

In the dry process method, metal oxide particles which are suspended in a gas phase are sprayed long with hydrophobicity promoting agents. Alternatively, hydrophobicity promoting agents are dripped into well stirred metal oxide powders and subsequently dried at 50–200° C., whereby the target product is prepared.

Listed as hydrophobicity promoting agents are silane coupling agents, titanium based coupling agents, aluminate based coupling agents, zircon-aluminum based coupling agents, and silicone oil. Particularly preferably employed agents are silane coupling agents represented by the following formula.

$$R_mSiY_n$$

wherein R represents a hydrocarbon group such as an alkoxy group; Y represents an alkyl group, a vinyl group, a glycidoxy group, or a methacryl group; m represents an integer of 1–3; and n represents an integer of 1–3.

Of silane coupling agents, particularly preferred is hexamethylsilazane.

Listed as specific examples of silane coupling agents are vinyltrimethoxysilane, vinyltriethoxysilane, γ-methacryloxypropyltrimethoxysilane, vinyltriacetoxysilane, methyltrimethoxysilane, methyltriethoxysilane, ethyltrimethoxysilane, ethyltriethoxysilane, propyltrimethoxysilane, propyltriethoxysilane, butyltrimethoxysilane, butyltrimethoxysilane, isobutyltrimethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, n-octadecyltrimethoxysilane, n-butyltrimethoxysilane, and n-octyltrimethoxysilane.

Other than these, preferably is employed hexamethyldisilazane.

The degree of the hydrophobic treatment is represented by methanol wettability, and its numerical value is preferably in the range of 40–95.

Methanol wettability, as described herein, refers to evaluation for wettability with methanol. A measurement method follows. Added to 50 ml of distilled water placed in an inner capacity 250 ml beaker was 0.2 g of collected metal oxide particles to be measured. Subsequently, methanol is gradually dripped into the slowly stirred above mixture employing the buret of which tip is immersed in the liquid composition, until all the metal oxide particles are wetted. hydrophobicity promoting degree is calculated based on the formula described below.

$$\text{Hydrophobicity promoting degree}=\{a/(a+50)\}\times 100$$

wherein a represents the volume (ml) of methanol which is necessary to completely wet the aforesaid metal oxide particles.

Preferred as hydrophobicity promoting agents are, for example, so-called coupling agents such as various titanium coupling agents or silane coupling agents and silicone oil. Further, preferred hydrophobicity promoting agents include higher fatty acid metal salts such as aluminum stearate, zinc stearate, or calcium stearate. Of these, most preferred are silane coupling agents which are applied to surface treatments.

Moisture content is determined employing the Carl Fischer method measurement apparatus "AQS-724" (manufactured by Hiranuma Sangyo Co., Ltd.). During measurement, care should be taken for samples following the recommendations below.

At an ambience of 30° C. and 30 percent relative humidity, a sample of metal oxide particles is collected in a bottle fitted with a screwed stopper. It is critical that the stopper is screwed down under the aforesaid ambience. If the stopper is not screwed down under the aforesaid ambience, it is likely that accurate moisture content is not determined. In addition, physical adsorption of a weak bonding force significantly affects the measurement of moisture content. Consequently it is necessary to pay the greatest care for the measurement of the moisture content. As for comparison, ambient air in the measurement place is collected and used for the measurement.

Production Method of Metal Oxide Particles

It is preferable that the metal oxide particles according to the present invention are produced employing a flame combustion method. Basically, at least two metal coupling agents such as silane coupling agents are blended in a liquid state and sprayed into the flame of a burner. As the amount of halogen incorporated in raw materials is increased, the domain diameter decreases. However, an excessively large amount does not result in formation of a domain-matrix structure due to lack of phase separation. The halogen amount in the raw materials is preferably 0—about 4 percent by weight. Further, it is possible to control the temperature of metal oxide particles and the domain diameter by varying the flame temperature. However, since the optimal conditions vary depending on each of the combinations, more assured production is carried out after determining conditions based on the preliminary tests.

Figure 5:
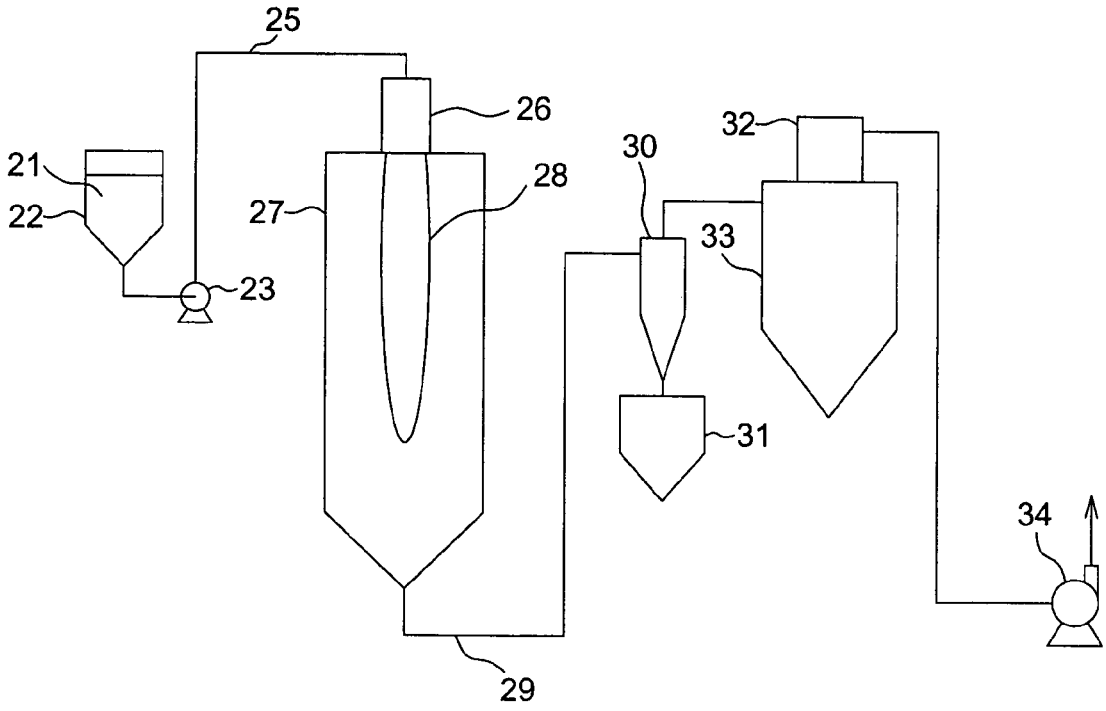
FIG. 5 is a view showing one example of a production apparatus of metal oxide particles.

Employed as a production apparatus is one which is shown in FIG. 5 as one example. FIG. 5 is a schematic sectional view of the aforesaid production apparatus which shows a specific method in which a mixture of metal coupling agents is supplied to a burner in the form of vapor and undergoes flame hydrolysis.

In FIG. 5, metal coupling agent mixture 21 is fed to main burner 26 fitted with a spray nozzle at the tip through feeding pipe 25, employing proportioning supply pump 23, from raw material tank 22. Metal coupling agent mixture 21 is sprayed into the interior of combustion furnace 26 and ignited by an auxiliary flame, whereby combustion flame 28 is formed. Metal oxide particles formed by combustion are cooled together with exhaust gas in flue 29, separated at cyclone 30 and bug filter 32, and collected in recovery units 31 and 33. The exhaust gas is exhausted by exhauster 34.

<<Electrostatic Image Developing Toner>>

Preferable features of the electrostatic image developing toner of the present invention will now be described, while resins and colorants which constitute the aforesaid toner of the present invention will be described in the production methods below.

(Toner without Corners)

In the toner of the present invention, in view of minimizing coagulation of toner particles, "toner particles without corners" are preferably employed as a particle shape. The aforesaid "toner particles without corners" are described with reference to FIG. 2.

In the toner according to the present invention, the ratio of toner particles without corners in the toner particles constituting the toner is preferably at least 50 percent by number, is more preferably 60–95 percent, and is most preferably 65–85 percent.

By controlling the ratio of toner particles without corners to at least 50 percent by number, fixability is enhanced due to a decrease in voids in the transferred toner layer (being a powder layer), whereby offsetting tends not to occur. Further, charge amount distribution is narrowed due to a decrease in toner particles which easily result in abrasion and breakage and exhibit portions in which electric charge is concentrated, whereby chargeability is stabilized, and excellent image quality can be achieved over an extended period of time.

Figure 2:
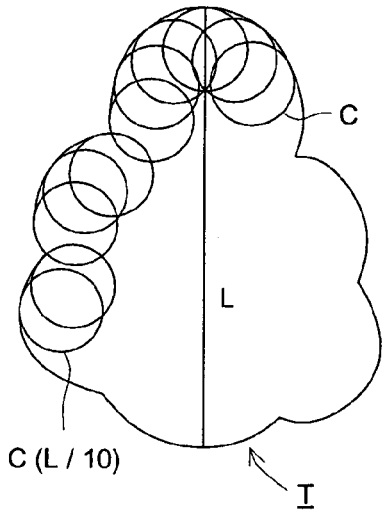
FIG. 2(*a*) is a descriptive view showing a projected image of a toner particle without corners, and (*b*) and (*c*) each are a descriptive view showing a toner particle with corners.
Figure 2:
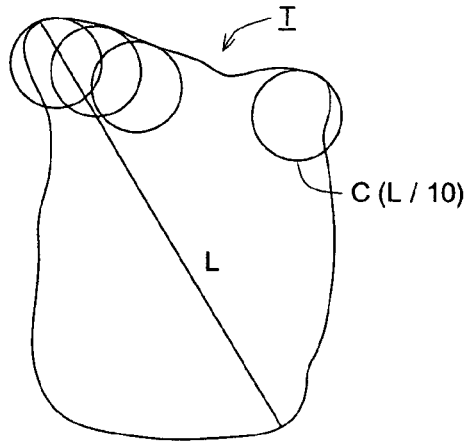
Figure 2:
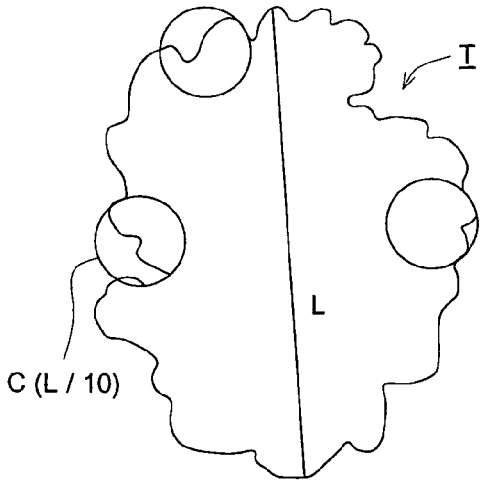

"Toner particle without corners", as described herein, refers to toner particles which substantially have no projections onto which charge is concentrated or which are easily subjected to abrasion due to stress, and refer to the toner particles without corners, specifically described below. Namely, as shown in FIG. 2(*a*), when circle C at a radius of (L/10), wherein L represents the long diameter of toner particle T, is rolled along the interior of the peripheral line of toner particle T while being brought into contact at one point of the peripheral line, and aforesaid circle C is substantially not placed beyond the exterior of toner T, the resulting toner particle is called a toner without corners. Further, "long diameter of a toner particle" refers to the width of the particle when the toner image projected onto a plane is interposed by two parallel lines and the distance between the lines is maximized. FIGS. 2(*b*) and 2(*c*) each show the projected image of a toner particle with corners.

The ratio of toner particles without corners was determined as described below. First, an image of toner particles enlarged by a scanning type electron microscope was captured. The image was further enlarged to achieve a magnification factor of 15,000. Subsequently, employing the resulting image, the presence and absence of corners was determined. This determination was carried out for 100 particles.

Methods to prepare the aforesaid particles without corners are not particularly limited. As noted above, examples of methods to control the shape factor include a method in which toner particles are sprayed into a heated air flow and a method in which, in a gas phase, toner particles are repeatedly impacted with mechanical energy. Alternatively, they may be prepared in such a manner that toner is added to toner-insoluble solvents and is provided with rotational flow.

<<Number Particle Size Distribution and Number Variation Coefficient of Toner Particles>>

Further, regarding the toner particles according to the present invention, the number variation coefficient of the number particle size distribution is preferably at most 27 percent, is more preferably 9–25 percent, is most preferably 12–21 percent.

The number particle size distribution and the number variation coefficient of toner particles will now be described.

"Number variation coefficient of the number particle size distribution" which is one variable representing the uniform shape of toner particles, is determined employing a Coulter Counter TA or a Coulter Multisizer (manufactured by Coulter, Inc.). In the present invention, a Coulter Multisizer was employed which was connected to a personal computer loaded with an interface (manufactured by Nikkaki Co.), which outputted a particle size distribution. An aperture of 100 μm was used in the aforesaid Coulter Multisizer. The volume and number of particles of 1 μm or more were then determined and the particle size distribution and the number average particle diameter were calculated. The number particle size distribution, as described herein, represents the relative frequency of toner particles with respect to the particle diameter, while the number average particle diameter, as described herein, represents a median diameter of the number average particle size distribution. "The number variation coefficient of the number particle size distribution" (hereinafter referred to as the number variation coefficient) of toner particles is calculated based on the formula below.

$$\text{Number variation coefficient of toner particles} = (S2/Dn) \times 100 \text{ (percent)}$$

wherein S2 represents the standard deviation of the number particle size distribution, and Dn represents the number average particle diameter (μm).

In the present invention, it is required that, as basic characteristics of toner, the charge amount distribution is narrow and the transfer efficiently is high. However, the critical requirement is that the aforesaid number variation coefficient of toner particles is controlled to be at most 27 percent. Further, when toner controlled as above is used in an image forming apparatus, accompanying effects are exhibited such that the charging characteristic of toner is stabilized, and insufficient cleaning tends not to occur.

Methods to control the number variation coefficient of toner particles are not particularly limited. For example, it is possible to use a method in which toner particles are classified employing forced air. In order to further decrease the number variation coefficient, classification in a liquid is effective. A classification method in a liquid includes one in which toner particles are prepared while subjected to classification recovery corresponding to the difference in the sedimentation rate generated due to the difference in toner particle diameter upon controlling the rotation frequency while employing a centrifuge.

Specifically, when toner particles are produced employing a suspension polymerization method, in order that the number variation coefficient of the number particle size distribution is at most 27 percent, it is essential to use a classification operation. In the suspension polymerization method, it is necessary that, prior to polymerization, polymerizable monomers are dispersed into a water-based medium to form oil droplets at the required size as toner particles. Namely, large oil droplets of polymerizable monomers are reduced nearly to the size of toner particles by repeating mechanical shearing with use of, for example, a homomixer or a homogenizer. In such a mechanical shearing method, the resulting number particle size distribution of oil droplets is broadened, whereby the particle size distribution of toner particles which are prepared by polymerizing the aforesaid monomers is also broadened. Due to that, the classicization operation becomes essential.

In a histogram which shows the number based particle size distribution in which natural logarithm lnD, wherein D (μm) represents the diameter of toner particles, is taken as the abscissa which is divided into a plurality of classes at an interval of 0.23, toner is preferred in which the sum (M) of the relative frequency (m1) of toner particles included in the most frequent class and the relative frequency (m2) of toner particles included in the second most frequent class is at least 70 percent.

When the sum (M) of the relative frequency (m1) and the relative frequency (m2) is controlled to be at least 70 percent, the particle size distribution of toner particles is narrowed. As a result, by employing the aforesaid toner in the image forming process, it is possible to assuredly retard the generation of selective development.

In the present invention, the aforesaid histogram which shows the number based particle size distribution, is prepared in such a manner that natural logarithm lnD (wherein D represents the diameter of each toner particle) is divided at a interval of 0.23 into a plurality of classes (0–0.23: 0.23–0.46: 0.46–0.69: 0.69–0.92: 0.92–1.15: 1.15–1.38: 1.38–1.61: 1.61–1.84: 1.84–2.07: 2.07–2.30: 2.30–2.53: 2.53–2.76 . . . . This histogram was prepared as follows. Particle diameter data determined by a Coulter Multisizer under the conditions described below are transferred to a computer via an I/O unit and analyzed employing the particle size distribution analysis program installed in the aforesaid computer.

<<Measurement Conditions>>

(1) Aperture: 100 μm (2) Sample preparation method: While stirring, a suitable amount of a surface active agent (a neutral detergent) is added to 50–100 ml of an electrolyte (ISOTON R-11, manufactured by Coulter Scientific Japan Co.) and 10–20 mg of a sample to be measured is added to the resulting mixture. Subsequently, the resulting mixture is dispersed for one minute, employing an ultrasonic homogenizer.

(Encapsulation and Surface Modification)

It is preferable that toner particles according to the present invention are encapsulated or surface-modified employing resinous compositions which differ from each other.

Encapsulation or surface modification, as described herein, is defined as follows. The viscoelastic image of the section of a toner particle is measured employing a commercially available scanning type interatomic force microscope. When the hardness or viscoelastic behavior differs between the interior and the surface of the toner particle, it is defined that encapsulation is achieved. On the other hand, when the hardness partially differs or the viscoelastic behavior partially differs, it is defined that the surface modification is achieved.

Listed as a means to prepare encapsulated or surface-modified toner particles is an operation in which the surface of toner particles is entirely covered (encapsulation) or partially covered (surface modification) by resins which have higher Tg (being the glass transition point) than that of resins in the interior of the toner particle.

<<Release agents>>

It is preferable that release agents be incorporated into the particles of the toner of the present invention.

By employing a toner which is prepared by salting-out/coalescing resinous particles comprising release agents, it is possible to uniformly incorporate the release agents into the toner particle. Further, it is possible to form a toner in which the release agents are incorporated near the surface of the toner particle.

By salting-out/coalescing, in a water-based medium, resinous particles in which release agents are uniformly incorporated as above with colorant particles, it is possible to prepare toner in which release agents are microscopically dispersed.

Preferred as release agents are compounds represented by the general formula described below.

$$R^1—(OCO—R^2)_n$$

In the above general formula, n is an integer of 1–4, is preferably 2–4, is more preferably 3–4, and is most preferably 4.

$R^1$ and $R^2$ each represent a hydrocarbon group which may have a substituent.

The number of carbon atoms in $R^1$ is preferably 1–40, is more preferably 1–20, and is most preferably 2–5.

The number of carbon atoms in $R^2$ is preferably 1–40, is more preferably 16–30, and is most preferably 18–26.

Representative exemplified compounds will now be described.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6)

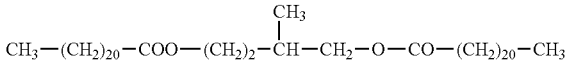

7)

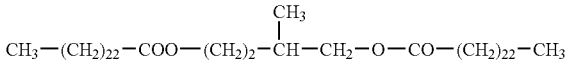

8)

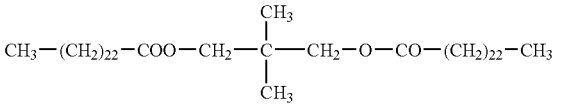

9)

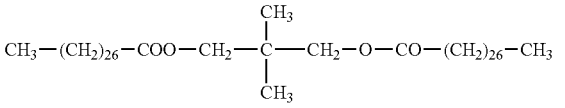

10)

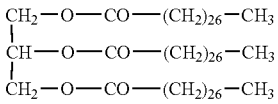

11)

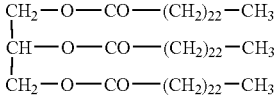

-continued

12)

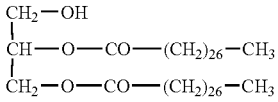

13)

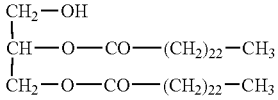

14)

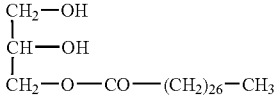

15)

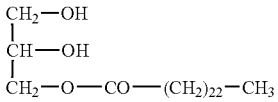

17)

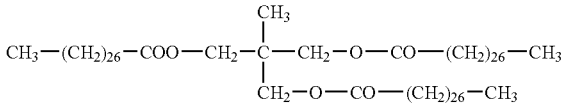

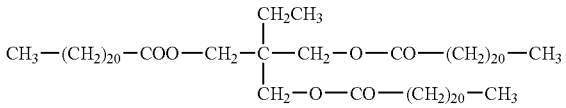

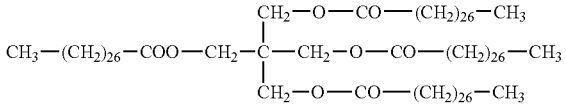

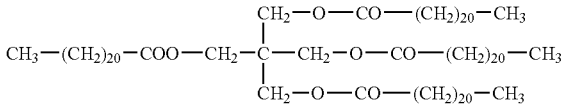

20)

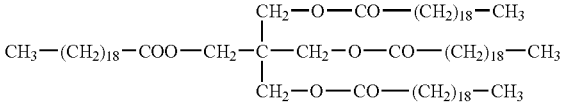

21)

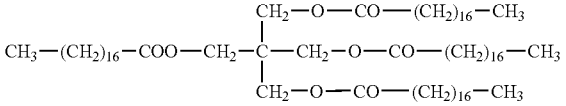

The added amount is preferably 1–30 percent by weight with respect to all the toner, and is more preferably 3–25 percent by weight.

<<Production Method of Electrostatic Image Developing Toner>>

The production method of the electrostatic image developing toner of the present invention will now be described.

The toner of the present invention can be prepared in such a manner that resinous particles are formed in the absence of colorants and a colorant particle dispersion is added to aforesaid resinous particle dispersions, whereby the aforesaid resinous particles and colorant particles are salted out, aggregated and coalesced.

As noted above, by performing the preparation of resinous particles in a system under the absence of colorants, the polymerization reaction to prepare composite resinous particles is not hindered. Consequently, when toner of the present invention is used, excellent offsetting resistance is not degraded and fixing units as well as images are not stained.

Further, the assured polymerization reaction to prepare resinous particles is conducted. As a result, neither monomers nor oligomers remain in the prepared toner particles, whereby in the thermal fixing process of the image forming method which employs the aforesaid toner, unpleasant odors are not generated.

Still further, the surface characteristics of the prepared toner are homogeneous and the resulting charge amount distribution is narrowed. As a result, it is possible to form images with excellent sharpness over an extended period of time.

As resinous particles which constitute the toner of the present invention, multilayer structured resinous particles are preferred in which one or at least two covering layers are formed, which are comprised of resins which differ in molecular weight and/or compositions from resins which form the aforesaid nucleus particles so as to cover the surface of nucleus particles comprised of resins.

Namely, it is preferable that the molecular weight distribution of resinous particles is not a monodispersion, and the resinous particles exhibit a molecular weight gradient commonly over the central portion (the nucleus)–the outer layer (shell).

In the present invention, in order to prepare resinous particles, it is preferable to use a "multistage polymerization method" in view of controlling the molecular weight distribution, namely in view of securing of the fixing strength and the offsetting resistance. The "multistage polymerization method" to prepare resinous particles, as described in the present invention, refers to the following method. In the presence of resinous particles (n) which are prepared in such a manner that monomers (n) are subjected to polymerization (n stage), monomers (n+1) are subjected to polymerization (n+1 stage) and covering layer (n+1) comprised of the polymers (the constitution resins of resinous particles (n)) refer to those which differ in dispersion and/or composition) is formed on the surface of the aforesaid resinous particles (n).

The case in which resinous particles (n) are nucleus particles, that is (n =1), refers to "two stage polymerization method". The case in which resinous particles (n) are composite resinous particles, that is ($n \geqq 2$), refers to a three or more stage polymerization method.

In composite resinous particles prepared by a multistage polymerization method, present is a plurality of resins which differ in compositions and/or the molecular weight. Accordingly, toner which is prepared by salting-out, aggregating, and coalescing the aforesaid composite resinous particles results in minimal fluctuation of composition, molecular weight, and surface characteristics among toner particles.

When such a toner is employed in which the composition, molecular weight, and surface characteristics are uniform among toner particles, in an image forming method comprised of a fixing process employing a contact heating system, it is possible to enhance offsetting resistance and twining minimizing characteristics while maintaining the desired adhesion (high fixing strength) to an image support, whereby it is possible to prepare images with optimal gloss.

One specific example of the production method of the electrostatic image developing toner of the present invention is described below. The aforesaid method is comprised of:

(1) a polymerization process to prepare resinous particles
(2) a salting-out, aggregating, and coalescing process (II) to prepare toner particles by salting out, aggregating, and coalescing resinous particles and colorant particles
(3) a filtration and washing process which collects toner particles from a toner particle dispersion through filtration and removes surface active agents from the toner particles
(4) a drying process which dries the washed toner particles, and
(5) a process which adds external additives to the dried toner particles.

Each of the processes will now be described.

In order to incorporate release agents into resinous particles (being nucleus particles), it is possible to use a method in which the release agents are dissolved in monomers and the resulting monomer solution is dispersed in the form of oil droplets, whereby the resulting system undergoes polymerization.

<<Salting-Out, Aggregating, and Coalescing Process (II)>>

The aforesaid salting-out, aggregating, and coalescing process (II) is a process to prepare non-spherical toner particles by salting-out, aggregating and coalescing (salting-out and coalescence result simultaneously) the resinous particles prepared by polymerization process (I) and colorant particles.

In the aforesaid salting-out, aggregating, and coalescing process (II), composite resinous particles and colorants particles may be salted out, aggregated and coalesced by adding release agents such as ester wax as well as internal additive particles (being minute particles at a number average primary particle diameter of about 10–about 1,000 nm) such as a static charge controlling agent.

The colorant particles may be subjected to surface modification. Herein, employed as surface modifiers may be those known in the art.

The colorant particles are subjected to the salting-out, aggregating, and coalescing process in a dispersed state in water based media. Listed as water based media in which the colorant particles are dispersed may be aqueous solutions in which surface active agents are dissolved at a concentration more than or equal to their critical micelle concentration (CMC).

Employed as surface active agents may be the same as those which are used in multistage polymerization process (I).

Homogenizers which are applied to the dispersion process of colored particles are not particularly limited. However, preferably listed are stirring apparatuses provided with a high speed rotating rotor such as "CLEARMIX" (manufactured by M-Technique Co.), ultrasonic homogenizers, mechanical homogenizers, pressure homogenizer such as Manton-Gaulin or pressure type homogenizers, and medium type homogenizers such as a Getzmann mill or a diamond fine mill.

In order to salting out, aggregate, and coalesce resinous particles and colorant particles, it is preferable that coagulants are added to a dispersion, in which resinous particles and colorant particles are dispersed, at a concentration of at least the critical aggregation concentration and the resulting dispersion is simultaneously heated to at least the glass transition temperate (Tg) of the resinous particles.

It is more preferable that aggregation terminating agents are added at the stage in which composite resinous particles reach the desired diameter by the addition of coagulants. Preferably employed as aggregation terminating agents are monovalent metal salts, and specifically sodium chloride.

Temperature for slating-out, aggregation, and coalescence is suitably (Tg+10)–(Tg+50)° C., and is particularly preferably (Tg+25)–(Tg+40)° C. In order to effectively achieve coalescence, added may be organic solvents which are infinitely dissolved in water.

Herein, listed as coagulants used during the salting-out, aggregation and coalescence, may be the alkali metal salts, and alkali earth metal salts as listed above.

The salting-out and aggregation according to the present invention will now be described.

In the present invention, achieving "salting-out, aggregation, and coalescence" refers to an operation in which salting-out (aggregation of particles) and coalescence (disappearance of the interface between particles) occur simultaneously or salting-out and coalescence are caused to occur simultaneously.

In order to simultaneously achieve salting-out and coalescence, it is preferable that particles (composite resinous particles and colorant particles) are aggregated under temperature conditions of at least the glass transition temperature (Tg) of resins constituting the composite resinous particles.

It is preferable that the electrostatic image developing toner of the present invention is prepared in such a manner that, in the absence of colorants, resinous particles are formed; a colorant particle dispersion is added to the aforesaid composite resinous particle dispersion or if desired, a release agent dispersion is added; and the aforesaid resinous particles, together with colorant particles, release agents, and charge controlling agents, are salted out, aggregated and coalesced.

As noted above, by preparing resinous particles in a system under the absence of colorants, a polymerization reaction to prepare composite resinous particles is not hindered. As a result, by employing the toner of the present invention, excellent offsetting resistance is not degraded and fixing units as well as images are not stained due to accumulation of the toner.

Further, an assured polymerization reaction to prepare the composite resinous particles undergoes. As a result, monomers and oligomers do not remain in the prepared toner, whereby unpleasant odors are not generated in the thermal fixing process of the image forming method which employs the aforesaid toner.

Furthermore, the surface characteristics of the prepared toner particles are uniform, and the resulting charge amount distribution is narrowed, whereby it is possible to form images with excellent sharpness over an extended period of time. By employing such a toner that compositions, molecular weight, and surface characteristics among toner particles are uniform, in the image forming method comprising the fixing process based on a contact heating system, it is possible to enhance offsetting resistance while maintaining desired adhesion (high fixing strength) to image supports, whereby it is possible to prepare images with the desired gloss.

Listed as resins employed to form the resinous particles described above are, for example, thermoplastic binder resins. Specific examples include homopolymers or copolymers (styrene based resins) of styrenes such as styrene or α-methylstyrene; homopolymers or copolymers (vinyl based resins) of esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate; homopolymers or copolymers (vinyl based resins) of vinylnitriles such as acrylonitrile or methacrylonitrile; homopolymers or copolymers (vinyl based resins) of vinyl ethers such as vinyl methyl ether or vinyl isobutyl ether; homopolymers or copolymers (vinyl based resins) vinyl ketones such as vinyl methyl ketone, vinyl ethyl ketone, or vinyl isopropenyl ketone; homopolymers or copolymers (olefin based resins) of olefins such as ethylene, propylene, butadiene, or isoprene; non-vinyl condensation based resins such as epoxy resins, polyester resins, polyurethane resins, polyamide resins, cellulose resins, or polyether resins and graft polymers of these non-vinyl condensation based resins with vinyl based monomers. These resins may be employed individually or in combinations of at least two types.

Of these resins, vinyl based resins are particularly preferred. The vinyl based resins exhibit advantages so that it is possible to easily prepare a resinous particle dispersion through emulsion polymerization or seed polymerization, employing ionic surface active agents. Listed as the aforesaid vinyl based monomers are, for example, monomers such as acrylic acid, methacrylic acid, maleic acid, succinic acid, fumaric acid, vinylsulfonic acid, ethyleneimine, or vinylamine, which are raw materials for vinyl based polymer acids or vinyl based polymer bases. In the present invention, it is preferable that the aforesaid resinous particles incorporate the aforesaid vinyl based monomers as a monomer component. In the present invention, of these vinyl based monomers, vinyl based polymer acids are more preferred in view of easiness to undergo vinyl based resin forming reactions. Specifically, in view of the degree of polymerization and the control of glass transition point, dissociative vinyl based monomers, having a carboxyl group such as acrylic acid, methacrylic acid, maleic acid, succinic acid, or fumaric acid as a dissociation group, are particularly preferred.

The concentration of the dissociation group in the aforesaid dissociative vinyl based monomers can be determined employing the method described, for example, in Kobunshi Latex no Kagaku (Chemistry of Polymer Latexes) (published by Koubunshi Kanko Kai), in which quantitative analysis is carried out while dissolving particles such as toner particles from the surface. Further, employing the aforesaid method, it is possible to determine the molecular weight and the glass transition point of resins from the surface to the interior.

The number average diameter of the aforesaid resinous particles is customarily at most 1 μm (less than or equal to 1 μm), and is preferably 0.01–1 μm. When the aforesaid number average particle diameter exceeds 1 μm, the particle size distribution of the finally prepared electrostatic image developing toner is broadened and free particles are formed, whereby the resulting performance and reliability tend to degrade. On the other hand, when the number average particle diameter is in the aforesaid range, the aforesaid problems do not occur and deviation among toners decrease to improve deviation in the toner, whereby it is advantageous that fluctuation of performance and reliability is minimized. The aforesaid number average particle diameter can be determined employing, for example, a Coulter Counter.

The aforesaid colorant dispersion is prepared by dispersing at least one colorant. Listed as the aforesaid colorants are, for example, various pigments such as carbon black, chrome yellow, Hansa yellow, benzidine yellow, surene yellow, quinoline yellow, permanent orange GTR, pyrazolone orange, vulcan orange, Watchung Red, permanent red, brilliant carmine 3B, brilliant carmine 6B, duPont oil red, pyrazolone red, lithol red, rhodamine B lake, lake red C, rose Bengal, aniline blue, ultramarine blue, chalcoyl blue, methylene blue chloride, phthalocyanine blue, phthalocyanine green, or malachite green oxalate and various other dyes such as acridine based, xanthene based, azo based, benzoquinone based, azine based, anthraquinone based, dioxazine based, thiazine based, azomethine based, indigo based, thioindigo based, phthalocyanine based, aniline black based, polymethine based, triphenylmethane based, diphenylmethane based, thiazine based, thiazole based, or xanthene based dyes. These colorants may be employed individually or in combinations of at least two types.

The number average particle diameter of the aforesaid colorants customarily at most 1 μm (namely, less than or equal to 1 μm), is preferably at most 0.5 μm (namely, less than or equal to 0.5 μm) even at the largest, and is particularly preferably 0.01–0.5 μm. When the aforesaid number average particle diameter exceeds 1 μm, the particle size distribution of the finally prepared electrostatic image developing toner is broadened and free particles are formed, whereby the resulting performance and reliability tend to degrade. On the other hand, when the number average particle diameter is in the aforesaid range, the aforesaid problems do not occur and deviation among toners decreases to improve deviation in the toner, whereby it is advantageous that fluctuation of performance and reliability is minimized. Further, when the aforesaid number average particle diameter is at most 0.5 μm, advantages are exhibited in such a manner that the resulting toner particles result in excellent color forming properties, color reproduction, and OHP transparency. The aforesaid number average particle diameter can be determined employing, for example, a Microtruck.

Listed as static charge controlling agents employed in the present invention are, for example, quaternary ammonium salt compounds, nigrosine based compounds, dyes comprised of complexes of iron, chromium and the like, as well as triphenylmethane based pigments. In view of controlling the ionic strength which affects the stability during aggregation and coalescence and decreasing effluent contamination, preferred as the static charge controlling agents in the present invention are sparsely water-soluble components.

Developing agents employed in the present invention will now be described.

The toner of the present invention may be used either as a single component developing agent or a double component developing agent.

When employed as a single component developing agent, listed are a non-magnetic single component developing agent and a magnetic single component developing agent in which magnetic particles of about 0.1–about 0.5 μm are incorporated in the toner, but either may be employed.

(Carrier)

The toner of the present invention can be employed as a double component developing agent by blending with a carrier. In this case, employed as particles which constitute the host of the carrier are magnetic particles and binder type (resin dispersion type) core materials. Employed as magnetic particles may be prior art materials such as metals including iron, ferrites, or magnetites and alloys of these metals with metals such as aluminum or lead. Of these, ferrite particles are particularly preferred. Preferred as the aforesaid carriers particles are those of a number average particle diameter in the range of 20–80 μm. Further, a silicone-coated carrier is preferred which is prepared by coating the carrier surface with silicone.

The number average particle diameter of carriers can be determined employing a laser diffraction type particle size distribution measurement apparatus "HELOS" (manufactured by Sympatec Co.) as a representative apparatus.

The image forming method according to the present invention will now be described.

The image forming method according to the present invention, as described herein, refers to an image forming method which produces a number of image printed sheets in such a manner that an electrostatic latent image is formed by charging the photoreceptor surface and performing image exposure, is then transferred to a transfer material employing a contact transfer system, and thereafter, each of the processes, such as separation, fixing and cleaning, is repeated.

Figure 3:
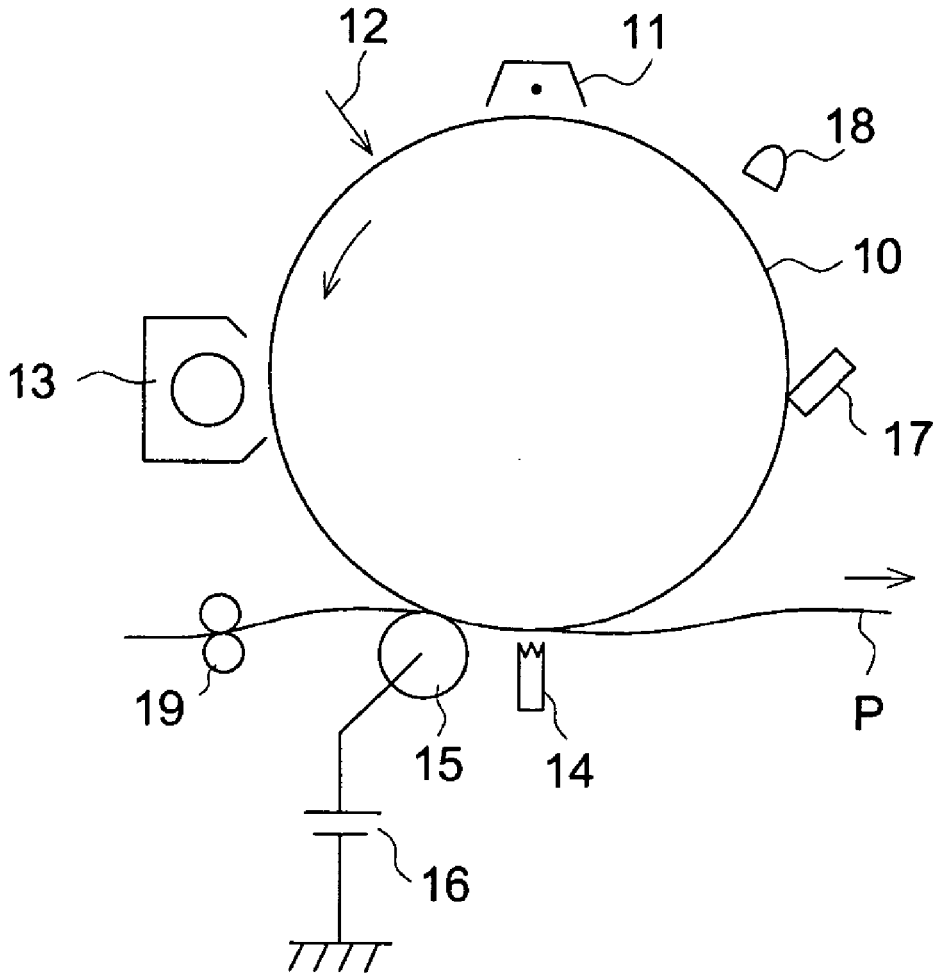
FIG. 3 is a schematic sectional view showing one example of an image forming apparatus employing a transfer roller.

FIG. 3 is a schematic view showing the constitution of one example of an image forming apparatus employing a transfer roller.

In FIG. 3, photoreceptor 10 is an organic photoreceptor which rotates in the arrowed direction, and numeral 11 is a charging unit which uniformly charges the aforesaid photoreceptor. The charging unit may be a corona discharging unit, a roller charging unit, or a magnetic brush charging unit. Numeral 12 is an analogue image exposure light or a digital image exposure light employing a semiconductor laser or light emitting diode, and an electrostatic latent image is formed on the photoreceptor employing the aforesaid image exposure light. The resulting electrostatic latent image is subjected to either contact or non-contact development, employing development unit 13 loaded with a developing agent comprising minute toner particles at a number average particle diameter of 2–10 μm, whereby a toner image is formed on the aforesaid photoreceptor.

The aforesaid toner image is transferred onto synchronously conveyed transfer material P under application of direct current bias by transfer roller 15 and pressure applied to the photoreceptor is 2.5–100 kPa or preferably 10–80 kPa.

Power source 16 of a direct current bias, which is subjected to bias application to the aforesaid transfer roll 15, is preferably either a constant-current power source or a constant-voltage power source. In the case of the aforesaid constant-current power source, the current is 5–15 μA, while in the case of the aforesaid constant-voltage power source, the voltage is 400–1,500 V in terms of absolute voltage.

Transfer material P, onto which the image has been transferred employing aforesaid transfer roller 15, is separated from photoreceptor 10 employing separation electrode 14, transferred to a fixing unit (not shown), and then thermally fixed.

After the transfer, the surface of the photoreceptor is cleaned by cleaning blade 17 and then subjected to static elimination employing pre-charging lamp (PCL) 18 and prepared for the following image formation. Herein, numeral 19 is a paper feeding roller.

(Fixing Method)

Further, a contact heating system which is a suitable fixing method employed in the present invention is described with reference to FIGS. 4(*a*) and (*b*).

Figure 4:
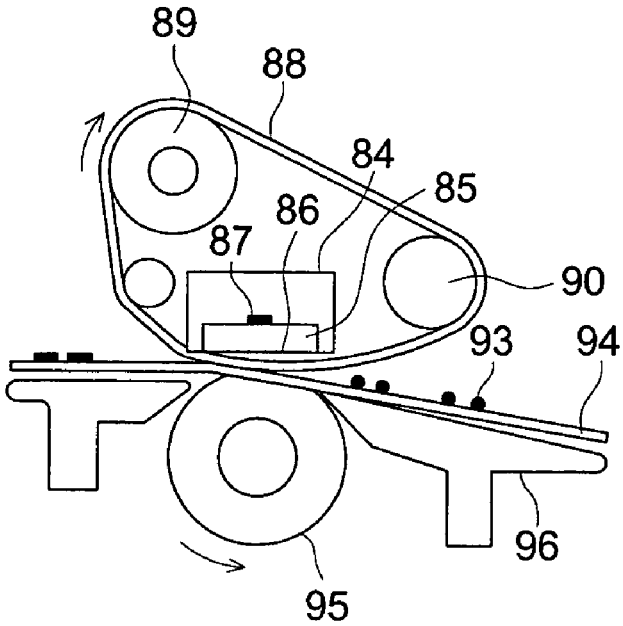
FIG. 4 is a sectional view showing the structure of a fixing unit using a transfer belt.
Figure 4:
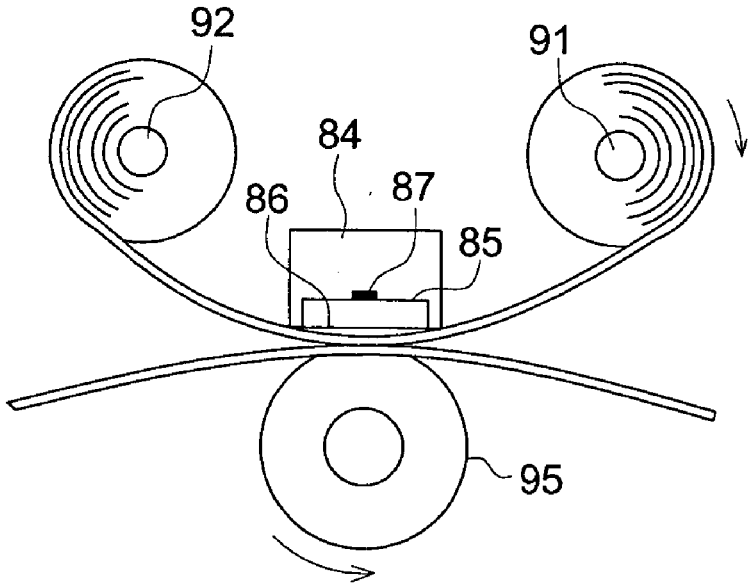

Each of FIGS. 4(*a*) and (*b*) is a schematic sectional view showing one embodiment of a fixing unit employed in the present invention.

In the present invention, specifically listed as contact heating systems may be a heat and pressure fixing system, as well as a heated roller fixing system and a pressure contact heat fixing system in which fixing is carried out employing a rotating pressure member having an integral heating.

In many cases, the heated roller fixing system is comprised of the upper roller having a heating source in the interior of a cylinder comprised of iron or aluminum of which surface is covered with tetrafluoroethylene, or polytetrafluoroethylene-perfluoroalkoxyvinyl ether copolymers, and the lower roller which is formed employing silicone rubber. Representative examples as a heat source include linear heaters which heat the upper roller to 120–200° C. In a fixing section, pressure is applied between the upper and lower rollers, and the lower roller is defoamed to form a so-called nip. The nip width is commonly 1–10 mm and is preferably 1.5–7 mm. The linear fixing rate is preferably 40–600 mm/second.

A fixing cleaning mechanism may be provided and used. Employed as this system may be a system in which silicone oil is supplied onto an upper fixing roller or film and a method in which cleaning is carried out employing silicone oil-impregnated pads, rollers, and webs.

A system will now be described in which fixing is carried out employing a rotating pressure member having an integral heating body.

The aforesaid fixing system refers to a system in which pressure contact thermal fixing is carried out employing an integral heating body and a pressure member which is brought into pressure contact with the aforesaid heating body while facing with each other, and brings a transfer material into close contact with the heating body via a film.

The pressure contact thermal fixing unit comprises a heating body at a smaller heat capacity than conventional heating rollers and a linear heating section at right angles to the conveying direction of transfer materials. The maximum temperature of the heating section is commonly 100–300° C.

Pressure contact thermal fixing, as described herein, refers to a fixing method in which fixing is achieved by pressing an unfixed toner image onto a heating source, including a system in which, as generally frequently employed, an unfixed toner image carrying transfer material is passed between the heating member and the pressure member. By such action, since heating is quickly carried out, the rate of fixing can be enhanced. However, problems occur in which, since it is difficult to control temperature, so-called toner offsetting tends to occur which refers to residual toner adhered to the portion with which unfixed toner on the surface portion of the heating source is directly brought into contact, and problems such as the transfer material being wound onto the fixing unit tends to result.

In the aforesaid fixing system, a low heat capacity linear heating body fixedly supported by an apparatus is prepared by applying electrical resistance materials onto an aluminum substrate at a thickness of 0.2–5.0 mm, preferably 0.5–3.5 mm, at a width of 10–15 mm, and a longitudinal length of 240–400 mm, and is electrically energized from both ends.

Direct current at 100 V in a pulse shape is supplied to the aforesaid heating body while the pulse width is varied depending on the temperature and energy discharge amount controlled by the thermal sensor. In the low heat capacity linear heating body, when the temperature determined by the thermal sensor is T1, surface temperature T2 of the film facing the electric resistance material is lower than T1. Herein, T1 is preferably 120–220° C., and T2 is preferably 0.5–10° C. lower than temperature T1. Further, surface temperature T3 of the film material in the portion in which the film is peeled from the toner surface is to be nearly equal to T2. As noted above, the film moves in the middle arrow direction in FIG. 4(*a*) while coming into contact with the heating body which is subjected to energy control and temperature control. Used as the fixing film may be endless loops of heat resistant film at a thickness of 10–35 μm comprised of, for example, polyester, polyperfluoroalkoxyvinyl ether, polyimide, and polyetherimide, which are, in most cases, coated with a 5–15 μm thick release agent layer comprised of fluorine resins such as Teflon (registered trade mark) incorporating electrically conductive materials.

The film is conveyed in the arrowed direction without wrinkling and twisting while driving force and tension are applied employing a driving roller and a driven roller. The linear speed of the fixing unit is preferably 40–600 mm/second.

A pressure roller comprised of an elastic rubber layer such as silicone rubber exhibiting high release properties, rotates under pressure contact while brought into pressure contact with the heating body via the film material.

In the foregoing, description was made with reference to the example in which a loop film was used. However, as shown in FIG. 4(*b*), film material with ends may be utilized employing an unwinding shaft and a winding shaft. Further, employed may be a cylindrical one having no driving roller in the interior.

The aforesaid fixing unit may be employed while provided with a cleaning mechanism. Employed as cleaning systems are a system in which various types of silicone oil is supplied to the fixing film, and a system in which cleaning is carried out employing pads impregnated with various types of silicone oil, rollers, and webs.

Employed as silicone oil are polydimethylsiloxane, polymethylphenylsiloxane, and polydiphenylsiloxane. In addition, fluorine-containing siloxanes can suitably be employed.

Each of FIGS. 4(*a*) and (*b*) is a sectional view showing the structure of one example of the aforesaid fixing unit.

In FIG. 4(*a*), numeral 84 is a low heat capacity linear heating body integral to the apparatus. One example is that aluminum substrate 85 at a thickness of 1.0 mm, a width of 10 mm and a length of 240 mm is coated with electrically resistant material 86, and electrical voltage is supplied from both ends.

Electricity is supplied to the aforesaid heating body, for example, at DC 100 V commonly in a pulse shape at a frequency of 20 milliseconds. The temperature is controlled by signals from temperature detecting element 87 to maintain a specified temperature. Due to this, the pulse width varies depending on the energy discharge amount, and the example of the range is 0.5–5 milliseconds.

Toner is thermally fixed by bringing transfer material 94 carrying unfixed toner image 93 into contact with heating body 84 controlled as above via moving film 88.

Film 88 used herein moves without wrinkling under such a state in which tension is applied using driving roller 89 and driven roller 90. Numeral 95 is a pressure roller covered with an elastic rubber layer comprised of silicone rubber and the like and applies a linear pressure of 0.4–2.0 N to the heating body via the film. Unfixed toner image 93 on transfer material 94 is led to a fixing section by feeding guide 96, whereby a fixed image is prepared by heating.

In the foregoing, description was made with reference to a closed loop. However, as shown in FIG. 4(*b*), the fixing film may have ends while using film sheet unwinding shaft 91 and winding shaft 92.

EXAMPLES

The present invention will now be described with reference to examples.

Example 1

Production examples of metal oxide particles according to the present invention will now be described. Herein, the apparatus shown in FIG. 5 is used to produce metal oxide particles.

At room temperature, raw materials combined as shown in Table 1 were mixed and the resulting liquid composition was fed to a burner arranged at the top portion of a vertical type combustion furnace. Subsequently, in the spray nozzle arranged at the tip portion of the burner, minute liquid droplets were sprayed employing air as a spray medium, whereby combustion was carried out employing an auxiliary flame generated by combustion of propane. Supplied as combustion supporting gas was air from the burner. During this operation, the supply amount of raw materials was controlled to be 5–8 kg/hour, the amount of propane was controlled to be 0.4 $Nm^3$, the supply amount of air was controlled to be 15–184 $Nm^3$/hour, and the adiabatic flame temperature was controlled to be 2,000–6,000° C., whereby Metal Oxide Particles 1–7 and Comparative Metal Oxide Particles 1–2 shown in Table 2 were produced. Herein, $Nm^3$ represents the volume (in $m^3$) of 1 normal gas at 0° C. and one atmospheric pressure.

The adiabatic flame temperature refers to, under assumption of an adiabatic system, the temperature which is reached by products or residues after combustion by the amount of heat attained by combustion while consuming heat. Consequently, at the adiabatic flame temperature, total combustion heat amount Q reaches Q1+Q2, wherein Q1 (kcal/hour) represents the combustion heat amount of liquid raw materials fed to the burner per hour and Q2 (kcal/hour) represents the combustion heat amount of the supporting gas per hour.

On the other hand, when each of the amount per hour of silica, water vapor, $CO_2$, $O_2$, and $N_2$ which are produced, by-produced or remained through combustion is represented by N1, N2, N3, N4, and N5 (mol/hour), respectively, each of their specific heat is represented by Cp1, Cp2, Cp3, Cp4, and Cp5 (kcal/mol° C.), respectively, the adiabatic flame temperature is represented by ta (° C.), and room temperature is 25° C., the combustion heat amount of is equivalent to the consumption heat amount, whereby Q=(N1Cp1+N2Cp2+N3Cp3+N4Cp4+N5Cp5) (ta−25) is obtained. Further, in the JANAF (Joint Army-Navy-Air-Force) Thermal Chemistry Table, standard enthalpy difference H° T−H° 298 (in KJ/mol) of various chemical substances from absolute temperature T° K (T=t° C.+273) is shown while taking absolute temperature 298° K as a standard. Namely, when a heat amount which is consumed by raising the temperature of 1 mol of a certain chemical substance from 25° C. to t° C. (t=T° K−273) is represented by E (kcal/mol), E=Cp(t−25)=H° T−H° 298)×0.2389 is easily obtained (wherein 1 KJ=0.2389 kcal). Consequently, in the previous formula, when each of the heat consumption amount from 298° K (25° C.) to T° K (T=273+t° C.) of metal oxide particles, water vapor, $CO_2$, and $O_2$ is represented by E1, E2, E3, E4, and E5 (kcal/mol), respectively, temperature which holds Q=N1E1+N2E2+N3E3+N4E4+N5E5 becomes adiabatic flame temperature ta.

While vigorously stirring 100 parts by weight of each of resulting Metal Oxides 1–7 and Comparative Metal Oxides 1–2 in a mixing vessel, the aforesaid silica powder was subjected to a pre-treatment by spraying water of which pH was adjusted to 5.5 by the addition of acetic acid. Further, 4 parts by weight of hexamethyldisilazane were sprayed onto the aforesaid silica powder.

The resulting mixture was then heated to 120° C., and the surface of minute silica powders underwent silylation employing hexamethyldisilazane and was subjected to a surface coating treatment employing trimethylsilanol which was formed through hydrolysis of unreacted hexamethyldisilazane. Thereafter, unreacted hexamethyldisilazane, excessive trimethylsilanol, and water were removed. Silylation employing hexamethyldisilazane and partial surface coating employing trimethylsilanol were carried out, whereby each of amorphous Silica Powders 1–6 was prepared.

Each of Metal Oxide Particles 1–7 and Comparative Metal Oxide Particles 1–2 was captured by a cyclone and a bag filter. Subsequently, the average diameter of the domain was determined employing an electric field effect type transmission electron microscope, while the shape factor was determined employing an image analysis apparatus (Luzex F, manufactured by Nireco Co.).

The shape factor refers to the numerical value calculated by the following formula.

(Formula)

$$\text{Shape Factor } SF\text{-}1=\{(\text{maximum absolute length of a domain})^2\times\pi\}/\{(\text{projected area of a domain})\times 4\}=\{(\text{maximum diameter})^2\times\pi\}/\{(\text{sum of areas})\times 4\}$$

Further, the weight ratio of netal elements constituting a matrix and a domain was determined employing an energy dispersion type X-ray analytical apparatus (EDX) which was connected to the aforesaid apparatus.

Still further, the moisture content of metal oxide particles was determined employing a Karl Fischer moisture meter.

Table 1 shows the raw materials for forming metal oxide particles, while Table 2 shows physical properties of the resulting metal oxide particles.

TABLE 1

| | Raw Material 1 | | Raw Material 2 | | Raw Material 3 | |
|---|---|---|---|---|---|---|
| Metal Oxide Number | Name of Raw Material | Mixing Ratio (weight part) | Name of Raw Material | Mixing Ratio (weight part) | Name of Raw Material | Mixing Ratio (weight part) |
| 1 | Compound 1 | 72 | γ-glycidoxypropyltrimethoxysilane | 14 | Compound A | 14 |
| 2 | Compound 1 | 72 | γ-aminopropylmethoxysilane | 15 | Compound B | 13 |
| 3 | Compound 1 | 72 | N-phenyl-γ-aminopropyltrimethoxysilane | 12 | Compound C | 16 |
| 4 | Compound 1 | 84 | tetrachlorotitanium | 1 | Compound A | 15 |
| 5 | Compound 1 | 30 | γ-glycidoxypropyltrimethoxysilane | 14 | Compound A | 56 |

TABLE 1-continued

| Metal Oxide Number | Raw Material 1 | | Raw Material 2 | | Raw Material 3 | |
|---|---|---|---|---|---|---|
| | Name of Raw Material | Mixing Ratio (weight part) | Name of Raw Material | Mixing Ratio (weight part) | Name of Raw Material | Mixing Ratio (weight part) |
| 6 | Compound 1 | 94 | tetrachlorotitanium | 2 | Compound A | 4 |
| 7 | Compound 1 | 20 | γ-glycidoxypropyltrimethoxysilane | 24 | Compound A | 56 |
| Comparative 1 | Compound 2 | 84 | no addition | 0 | tetrachlorotitanium | 16 |
| Comparative 2 | Compound 3 | 16 | no addition | 0 | tetrachlorotitanium | 84 |

Compound 1: hexamethyldisiloxane
Compound 2: γ-chloropropyltrimethoxysilane
Compound 3: chlorotrimethylsilane
Compound A: triisostearylisopropyl titanate
Compound B: neoalkoxytrisneodecanoyl zirconate
Compound C: acetoalkoxyaluminum diisopropylate

TABLE 2

| Metal Oxide Particle No. | Characteristics of Metal Oxide Particles | | | | | | | | |
|---|---|---|---|---|---|---|---|---|---|
| | Presence or Absence of Domain Matrix Structure (% by number) | Matrix Composition | Domain Composition | Shape Factor of Domain | Average of Primary Particle Diameter of Metal Oxide Particles (nm) | Average of Primary Particle Diameter of Domain (nm) | Ratio of Domain Diameter to Particle Diameter | Weight Ratio of Domain (weight %) | Moisture Content of Metal Oxide Particles (weight %) |
| 1 | 5.0 | silica | $TiO_2$ | 1.08 | 87 | 11 | 0.126 | 19 | 0.46 |
| 2 | 11.1 | silica | $ZrO_2$ | 1.04 | 105 | 15 | 0.143 | 22 | 0.23 |
| 3 | 3.1 | silica | $Al_2O_3$ | 1.09 | 58 | 6 | 0.103 | 21 | 0.64 |
| 4 | 38.5 | silica | $TiO_2$ | 1.16 | 41.4 | 2.1 | 0.051 | 11 | 0.6 |
| 5 | 82.0 | silica | $TiO_2$ | 1.03 | 154 | 28.7 | 0.186 | 59 | 1.8 |
| 6 | 1.0 | silica | $TiO_2$ | 1.22 | 24.4 | 1.2 | 0.049 | 12 | 0.6 |
| 7 | 94.3 | silica | $TiO_2$ | 1.01 | 287 | 58.6 | 0.204 | 58 | 1.8 |
| Comparative 1 | absence | — | — | — | — | — | — | — | 1.1 |
| Comparative 2 | absence | — | — | — | — | — | — | — | 1.9 |

Example 2

<<Production of Electrostatic Image Developing Toner 1>>

Electrostatic Image Developing Toner (hereinafter also referred simply to as Toner) was prepared via the preparation of Toner Resin Dispersion 1 and the formation of Colored Particle 1, as described below.

<<Preparation of Latex 1HML>>

(1) Preparation of Nucleus Particles (First Stage Polymerization): Charged into a 5,000 ml separable flask fitted with a stirring unit, a thermal sensor, a cooling pipe, and a nitrogen feeding unit, was a surface active agent solution (being a water-based medium) which was prepared by dissolving 7.08 weight parts of an anionic surface active agent (101) in 3,010 weight parts of ion-exchange water, and while stirring at 230 rpm, the contents of the flask was heated to 80° C. under a flow of nitrogen.

(101) $C_{10}H_{21}(OCH_2CH_2)_2OSO_3Na$

Added to the aforesaid surface active agent solution was an initiator solution which was prepared by dissolving 9.2 parts by weight of a polymerization initiator (potassium persulfate: KPS) in 200 parts by weight of ion-exchange water. After raising the temperature to 75° C., a monomer mixed liquid composition comprised of 70.1 parts by weight of styrene, 19.9 parts by weight of n-butyl acrylate, and 10.9 parts by weight of methacrylic acid was dripped over one hour, and the resulting system underwent polymerization (first stage polymerization) for two hours while stirred and heated at 75° C., whereby a latex (a resinous particle dispersion comprised of high molecular weight resins) was prepared. The resulting latex was designated as "Latex (1H)".

(2) Formation of Interlayer (Second Stage Polymerization): Added to a monomer mixed liquid composition comprised of 10.6 parts by weight of styrene, 30.0 parts by weight of n-butyl acrylate, 6.2 parts by weight of methacrylic acid, and 5.6 parts by weight of n-octyl-3-mercaptopropionic acid ester, charged into a flask fitted with a stirring unit were 98.0 parts by weight of the compound (hereinafter referred to as "Exemplified Compound (19)") represented by aforesaid formula (19) as a crystalline substance and completely dissolved while heated to 90° C., whereby a monomer solution was prepared.

On the other hand, a surface active agent solution prepared by dissolving 1.6 parts by weight of an anionic surface active agent (the aforesaid formula (101)) in 2,700 ml of ion-exchange water was heated to 98° C., and then added with 28 parts by weight at solid conversion of aforesaid Latex (1H) which was a dispersion of nucleus particles. Thereafter, the aforesaid monomer solution of Exemplified Compound (19) was mixed and dispersed for 8 hours, employing a mechanical homogenizer "CLEARMIX" (manufactured by M-Technique Co. Ltd.) employing a circulation path, whereby a dispersion (an emulsified liquid composition) comprised of emulsified particles (oil droplets) was prepared.

Subsequently, an initiator solution prepared by dissolving 5.1 parts by weight of a polymerization initiator (KPS) in 240 ml of ion-exchange water and 750 ml of ion-exchange water were added to the resulting dispersion (being an emulsified liquid composition). The resulting system underwent polymerization (a second stage polymerization) while stirred at 98° C. over 12 hours, whereby a latex (being a dispersion comprising composite resinous particles in such a structure that the surface of the resinous particles comprised of high molecular weight resins is covered with medium molecular weight resins) was prepared. The resulting latex was designated as "Latex (1HM)".

The aforesaid Latex (1HM) was dried and observed employing a scanning type electron microscope. Particles (at 400–10,000 nm) comprised of Exemplified Compound (19), which were not enveloped by the latex, as a main component were then observed.

(3) Formation of Outer Layer (a Third Polymerization Stage): Added to Latex (1HM) prepared as above was an initiator solution prepared by dissolving 7.4 parts by weight of a polymerization initiator (KPS) in 200 ml of ion-exchange water, and a monomer mixed liquid composition comprised of 300 parts by weight of styrene, 95 parts by weight of butyl acrylate, 15.3 parts by weight of methacrylic acid, and 10.4 parts by weight of n-octyl-3-mercaptopropionic acid ester was dripped at 80° C. over a period of one hour. After completion of dripping, the resulting mixture underwent polymerization (being a third stage polymerization) while stirring for two hours, and then was cooled to 28° C., whereby a latex (being a dispersion of composite resinous particles which have a central portion comprised of high molecular weight resins, an interlayer comprised of medium molecular weight, and an outer layer comprised of low molecular weight resins in which Exemplified Compound (19) is incorporated into the aforesaid interlayer) was prepared. The resulting latex was designated as "Latex (1HML)".

The composite resinous particles constituting aforesaid Latex (1HML) had peaks of molecular weight of 138,000, 80,000, and 13,000, and the weight average particle diameter of the resulting composite resinous particles was 122 nm.

Dissolved in 1,600 ml of ion-exchange water were 59.0 parts by weight of anionic surface active agent (101), and 420.0 parts by weight of carbon black "Regal 330", manufactured by Cabot Co., were gradually added to the resulting solution. Subsequently, the resulting mixture was dispersed employing "CLEARMIX" (manufactured by M-Technique Co.), whereby a colorant particle dispersion (hereinafter referred to as "Colorant Dispersion 1") was prepared. The diameter of the colorant particles in the aforesaid colorant dispersion was determined employing an electrophoresis light scattering photometer "ELS-800" (manufactured by Otsuka Electronics Co. Ltd.), resulting in a weight average particle diameter of 89 nm.

Placed in a reaction vessel (a four-necked flask) fitted with a thermal sensor, a cooling pipe, a nitrogen inletting unit, and a stirring unit were 420.7 parts by weight of Latex 1HML, 900 parts by weight of ion-exchange water, and 166 parts by weight of Colorant Dispersion 1, and the resulting mixture was stirred. After adjusting the interior temperature of the vessel to 30° C., the pH of the resulting solution was adjusted to 10.0 by the addition of a 5 mol/L sodium hydroxide aqueous solution.

Subsequently, while stirring, an aqueous solution prepared by dissolving 12.1 parts by weight of magnesium chloride hexahydrate in 1,000 ml of ion-exchange water was added at 30° C. over a span of 10 minutes. After allowing the resulting mixture to stand for 3 minutes, the temperature was raised to 90° C. over a period of 6–60 minutes, whereby coalesced particles were formed. In such a state, the diameter of coalesced particles was continuously determined employing a "Coulter Counter TA-II". When the number average particle diameter reached 4 μm, growth of the particles was terminated by the addition of an aqueous solution prepared by dissolving 80.4 parts by weight of sodium chloride in 1,000 ml of ion-exchange water. Further, as a ripening treatment, the resulting liquid composition was heated while stirring at 98° C., whereby particle coalescence and phase separation of crystalline substances were allowed to continue.

Thereafter, the resulting composition was cooled to 30° C., and the pH was adjusted to 4.0 by the addition of hydrochloric acid and stirring was terminated. The resulting coalesced particles were subjected to solid-liquid separation employing a basket type centrifuge "MARK III Model No. 60×40", manufactured by Matsumoto Kikai Mfg. Co., Ltd.), whereby a colored particle cake was formed. The aforesaid colored particle cake was washed with water in a centrifuge, then transferred to a "Flash Jet Dryer" (manufactured by Seishin Kikaku Co., Ltd.), and dried to reach a moisture content of 0.5 percent by weight, whereby colored particles were prepared. Added to 100 parts by weight of the resulting colored particles were 1.0 part by weight of Metal Oxide Particles 1, described in Table 1, and 0.6 part by weight of hydrophobic silica at a primary particle diameter of 12 nm, and coarse particles were removed employing a 45 nm aperture sieve, whereby Electrostatic Image Developing Toner 1 (Toner 1) was prepared.

<<Preparation of Electrostatic Image Developing Toner 2>>

-Preparation of Minute Resinous Particle Dispersion-

A solution, prepared by mixing 370 parts by weight of styrene, 30 parts by weight of n-butyl acrylate, 8 parts by weight of acrylic acid, 24 parts by weight of dodecanediol, and 4 parts by weight of carbon tetrachloride, was added to a solution prepare by dissolving 6 parts by weight of a nonionic surface active agent and 10 parts by weight of an anionic surface active agent (dodecyl) in 550 parts by weight of ion-exchange water placed in a flask. The resulting mixture underwent polymerization and 50 parts by weight of ion-exchange water in which 4 parts by weight of ammonium persulfate were dissolved were added while slowly stirring over a period of 10 minutes. After replacing the ambience in the flask with nitrogen, the oil bath was heated so that contents in the flask reached 70° C. while stirring, and emulsion polymerization continued for 5 hours without any modification. The reaction resulted in minute resinous particle dispersion at 150 nm, 58° C. of T parts by weight, a weight average molecular weight Mw of 11,500, in which resinous particles were dispersed. The concentration of solids of the resulting dispersion was 40 percent by weight.

| Preparation of Release Agent Dispersion | |
|---|---|
| Paraffin wax (HNP0190 at a melting point of 85° C., manufactured by Nippon Seiro Co., Ltd.) | 100 weight parts |

-continued

| Preparation of Release Agent Dispersion | |
|---|---|
| Cationic surface active agent (Sanizol B50, manufactured by Kao Corp.) | 5 weight parts |
| Ion-exchange water | 240 weight parts |

The above components were dispersed for 10 minutes in a circular stainless steel flask, employing a homogenizer (Ultra-turrax T50, manufactured by IKA Labortechnik), and subsequently dispersed employing a pressure discharge type homogenizer, whereby Release Agent Dispersion 1 was prepared in which release agent particles were dispersed.

| Preparation of Coalesced Particles | |
|---|---|
| Minute resinous particle dispersion | 234 parts |
| Colorant Dispersion 1 | 40 parts |
| Release Agent Dispersion 1 | 40 parts |
| Polyaluminum chloride | 1.8 parts |
| Ion-exchange water | 600 parts |

The above components were mixed and dispersed in a circular stainless steel flask, employing a homogenizer (Ultra-turrax T50, manufactured by IKA Labortechnik). Thereafter, the resulting dispersion, which was stirred in the flask, was heated to 55° C. employing a heating oil bath. After retaining the temperature at 55° C. for 30 minutes, it was confirmed that D50 formed 4.8 μm coalesced particles. Further, the temperature of the heating oil bath was raised to 56° C. and retained for two hours, whereby D50 arrived at 5.9 μm. Thereafter, after 32 parts by weight of a minute resinous particle dispersion were additionally added to the dispersion comprising the resulting coalesced particles, the temperature of the heating oil bath was raised to 55° C. and retained for 30 minutes. After adjusting the pH of the dispersion comprising the aforesaid coalesced particles to 5.0 by the addition of 1 N sodium hydroxide, the resulting mixture was sealed in a stainless steel flask and heated to 95° C. while stirring employing a magnetic seal, maintained for 6 hours and then cooled to normal temperature. Thereafter, solid-liquid separation was carried out employing a basket type centrifuge "MARK III Model No. 60×40" (manufactured by Matsumoto Kikai Mfg. Co., Ltd.), whereby a colored particle cake was formed. The aforesaid colored particle cake was washed with water in the centrifuge, then transferred to "Flash Jet Dryer" (manufactured by Seishin Kikaku Co., Ltd.), and dried to arrive at a moisture content of 0.5 percent by weight, whereby colored particles were prepared. Subsequently, Toner 2 was prepared in the same manner as Toner 1, except that Metal Oxide Particles 1 was replaced with Metal Oxide Particles 2.

<<Preparation of Electrostatic Image Developing Toner 3>>

A mixture consisting of 165 parts by weight of styrene, 35 parts by weight of n-butyl acrylate, 10 parts by weight of carbon black, 2 parts by weight of a di-t-butylsalicylic acid metal compound, 8 parts by weight of a styrene-methacrylic acid copolymer, and 20 parts by weight of paraffin wax (at an mp of 70° C.) was heated to 60° C., and uniformly dissolve-dispersed at 12,000 rpm, employing a TK Homomixer (manufactured by Tokushu Kika Kogyo Co., Ltd.). Ten parts by weight of 2,2'-azobis(2,4-valeronitrile) as a polymerization initiator was then added to and dissolved in the resulting dispersion, whereby a polymerizable monomer composition was prepared.

Subsequently, 450 parts by weight of a 0.1 M aqueous sodium phosphate solution were added to 710 parts by weight of ion-exchange water, and 68 parts by weight of 1.0 M calcium chloride were gradually added to the aforesaid mixture while stirred at 13,000 rpm employing a TK Homomixer, whereby a suspension, in which tricalcium phosphate was dispersed, was prepared. The aforesaid polymerizable monomer composition was added to the resulting suspension and stirred at 10,000 rpm for 20 minutes employing a TK Homomixer, whereby a polymerizable monomer composition was granulated.

Thereafter, reaction was conducted at 75–95° C. for 5–15 hours, employing a commercially available reactor. Tricalcium phosphate was dissolve-removed employing hydrochloric acid. Thereafter, solid-liquid separation was carried out employing a basket type centrifuge "MARK III Model No. 60×40" (manufactured by Matsumoto Kikai Mfg. Co., Ltd.), whereby a colored particle cake was formed. The aforesaid colored particle cake was washed with water in a centrifuge, then transferred to "Flash Jet Dryer" (manufactured by Seishin Kikaku Co., Ltd.), and dried to arrive at a moisture content of 0.5 percent by weight, whereby colored particles were prepared. Subsequently, Toner 3 was prepared in the same manner as Toner 1, except that Metal Oxide Particle 1 was replaced with Metal Oxide Particle 3.

<<Preparation of Electrostatic Image Developing Toner 4>>

| (Preparation of Toner Dispersion) | |
|---|---|
| Polyvinyl butyral (2 percent by weight in polyvinyl acetate units, 19 percent by weight in polyvinyl alcohol units, and 79 percent by weight in polyvinyl acetal units, at an average degree of polymerization of 630) | 8 weight parts |
| 2-Methyl-2-butanol | 300 weight parts |
| Styrene | 82 weight parts |
| n-Butyl acrylate | 18 weight parts |

The above components were completely dissolved, and the following components were charged to the resulting solution.

| | |
|---|---|
| Carbon black | 7 weight parts |
| Glass beads (at a diameter of 1 mm) | 500 weight parts |

The resulting mixture was stirred for 6 hours employing a paint shaker followed by the removal of the glass beads employing a mesh.

Gradually fed to a polymerization vessel fitted with a mechanical stirrer and an inletting pipe for bubbling nitrogen, which was maintained at 15° C., were 300 parts by weight of the resulting dispersion and 3.6 parts by weight of 2,2'-azobisisobutylnitrile, whereby a polymerization reaction system was formed. At that time, the dispersion ratio $\phi$ of pigments was 1.01. Further, the amount of dissolved oxygen in the polymerization reaction system was 8.2 milliparts by weight per liter.

While maintaining the polymerization reaction system at 20° C., nitrogen was bubbled so that the amount of dissolved oxygen in the polymerization reaction system reached 0.2 milliparts per liter. The resulting system was heated to 75° C. and underwent polymerization while stirring for 12 hours. During the polymerization, nitrogen was kept bubbling.

After completing the reaction, the resulting system was cooled to 20° C. Thereafter, solid-liquid separation was carried out employing a basket type centrifuge "MARK III Model No. 60×40" (manufactured by Matsumoto Kikai Mfg. Co., Ltd.), whereby a colored particle cake was formed. The aforesaid colored particle cake was washed with water in the centrifuge and then transferred to a "Flash Jet Dryer" (manufactured by Seishin Kikaku Co., Ltd.), and dried to arrive at a moisture content of 0.5 percent by weight, whereby colored particles were prepared. Subsequently, Toner 4 was prepared in the same manner as Toner 1, except that Metal Oxide Particles 1 were replaced with Metal Oxide Particles 4.

<<Preparation of Electrostatic Image Developing Toner 5>>

| Preparation of Pigment Dispersion | |
|---|---|
| Polyester resin (at T weight parts of 60° C., a softening point of 98° C., and a weight average molecular weight of 18,000) | 50 parts |
| Carbon black | 50 parts |
| Ethyl acetate | 100 parts |

Glass beads were added to the dispersion comprised of the aforesaid material composition, and the resulting mixture was fed to a sand mill homogenizer.

While cooling the jacket of the aforesaid homogenizer, dispersion was carried out for 3 hours at a high speed mode, and the resulting dispersion was diluted with ethyl acetate, whereby Colorant Dispersion 2 at a colorant concentration of 15 percent by weight was prepared.

| Preparation of Minute Wax Particles | |
|---|---|
| Paraffin wax (at a melting point of 85° C.) | 15 parts |
| Toluene | 85 parts |

The aforesaid materials were charged into a homogenizer fitted with stirring blades, which had functions such that a heat medium was circulated around the vessel. While stirring at 83 rpm, the temperature was gradually raised and while maintaining the temperature at 100° C., stirring was carried out for 3 hours. Subsequently, while stirring, the temperature was lowered to room temperature at a rate of 2° C. per minute, whereby minute wax particles were deposited. The resulting wax dispersion was re-dispersed at a pressure of 550 k weight part/cm$^2$, employing a high pressure homogenizer APVAULIN HOMOGENIZER 15MR. In the same manner, the wax particle size was determined, resulting in 0.69 μm. The resulting minute wax particle dispersion was diluted with ethyl acetate to result in a wax concentration of 15 percent by weight.

| Preparation of Oil Phase | |
|---|---|
| Polyester resin (at a glass transition point of 60° C., a softening point of 98° C., and a weight average molecular weight of 18,000) | 85 parts |
| Colorant Dispersion 2 | 50 parts |
| Minute wax particle dispersion (at a wax concentration of 15 percent by weight) | 33 parts |
| Ethyl acetate | 32 parts |

After confirming that the polyester resin sufficiently dissolved the oil phase of the aforesaid material composition, preparation was carried out. The aforesaid oil phase was charged into a Homomixer (Ace Homogenizer, manufactured by Nippon Seiki Co., Ltd.) and stirred at 16,000 rpm for two minutes whereby a uniform oil phase was prepared.

| Preparation of Aqueous Phase | |
|---|---|
| Calcium carbonate (at an average particle diameter of 0.03 μm) | 60 parts |
| Pure water | 40 parts |

An aqueous calcium carbonate solution, which was prepared by stirring the aforesaid materials in a ball mill for 4 days, was used as an aqueous phase. The average particle size of the calcium carbonate was determined employing the aforesaid laser diffraction/scattering particle size distribution measurement apparatus LA-700 (manufactured by Horiba Ltd.), resulting in approximately 0.08 μm.

| | |
|---|---|
| Carboxymethylcellulose (Celogen BSH, manufactured by Dai-ichi Kogyo Seiyaku Co.) | 2 parts |
| Pure water | 98 parts |

Carboxymethylcellulose, which was obtained by stirring the aforesaid materials, was used as an aqueous phase.

| Preparation of Spherical Particles | |
|---|---|
| Oil phase | 55 parts |
| Aqueous phase (aqueous calcium carbonate solution) | 15 parts |
| Aqueous phase (aqueous carboxymethylcellulose solution) | 30 parts |

The above-mentioned materials were charged into a colloid mill (manufactured by Nippon Seiki Co., Ltd.) and emulsified at 9,400 rpm for 40 minutes at a gap distance of 1.5 mm. Subsequently, the aforesaid emulsion was charged into a rotary evaporator, and solvents were removed at room temperature under a reduced pressure of 30 mmH parts by weight for 3 hours. Thereafter, 12 M hydrochloric acid was added to arrive at a pH of 2 and calcium carbonate was removed from the surface of the toner particles. Thereafter, sodium hydroxide was added to reach a pH of 10, and stirring was carried out for one hour in an ultrasonic washing tank.

Subsequently, solid-liquid separation was carried out employing a basket type centrifuge "MARK III Model No. 60×40" (manufactured by Matsumoto Kikai Mfg. Co., Ltd.), whereby a colored particle cake was formed. The aforesaid colored particle cake was washed with water in a centrifuge, then transferred to a "Flash Jet Dryer" (manufactured by Seishin Kikaku Co., Ltd.), and dried to reach a moisture content of 0.5 percent by weight, whereby colored particles were prepared. Subsequently, Toner 6 was prepared in the same manner as Toner 1, except that Metal Oxide Particles 1 were replaced with Metal Oxide Particles 5.

<<Preparation of Electrostatic Image Developing Toner 6>>

Synthesis Example 1

Synthesis of Polyether Resin (A)

Placed in a high pressure reaction apparatus fitted with a stirring unit, a nitrogen inlet pipe, a thermometer, and a raw material injection inlet were 0.5 part of potassium hydroxide and 200 parts of toluene, acting as a solvent. The pressure and the temperature in the apparatus were maintained at 10 K weight parts/cm$^2$ and 40° C., respectively. While stirring, a mixed liquid consisting of 10.8 parts of propylene oxide and 89.2 parts of styrene oxide was injected little by little, and the variation of the molecular weight was traced based on the terminal group titration. When the number average molecular weight reached 7,000, the reaction was terminated. At that time, the total amount of injected monomers was 8.64 parts of propylene oxide and 1.4 parts of styrene oxide. Toluene and non-reacted monomers were distilled out from the resulting polymer solution at a reduced pressure of 4,000 Pa, whereby Polyether Resin (A-1) was prepared.

By employing dual shaft continuous kneader, a mixture consisting of 18 parts of Polyether Resin (A-1) prepared in Synthesis Example 1, 72 parts of Polyester Based Resin (B-1) prepared in Synthesis Example 3, and 10 parts of carbon black was converted to a colored resinous melt heated at 180° C., which was conveyed to a Cavitron CD1010 (a rotary type continuous homogenizer, manufactured by Eurotech Ltd.) at a rate of 100 parts by weight per minute. Placed in a separately prepared water-based media tank was diluted ammonia water at a concentration of 0.37 percent by weight, which was prepared by diluting reagent ammonia water with ion-exchange water. The aforesaid diluted ammonia water was heated to 150° C. employing a heat exchanger and transferred to the aforesaid Cavitron at a rate of 0.1 liter per minute at the same time as the transfer of the aforesaid colored resinous melt. Under operation conditions of a rotation frequency of 7,500 rpm of the rotator and a pressure of 5 K weight parts/cm$^2$, a dispersion was prepared at a temperature 160° C. at which colored spherical resinous particles were dispersed and cooled to 40° C. within 30 seconds. Thereafter, solid-liquid separation was carried out employing a basket type centrifuge "MARK III Model No. 60×40" (manufactured by Matsumoto Kikai Mfg. Co., Ltd.), whereby a colored particle cake was formed. The aforesaid colored particle cake was washed with water in a centrifuge and then transferred to a "Flash Jet Dryer" (manufactured by Seishin Kikaku Co., Ltd.), and dried to reach a moisture content of 0.5 percent by weight, whereby colored particles were prepared.

Subsequently, Toner 6 was prepared in the same manner as Toner 1, except that Metal Oxide Particles 1 were replaced with Metal Oxide Particles 6.

<<Preparation of Electrostatic Image Developing Toner 7>>

(Preparation of Polyester Resin B)

Placed in a polymerization condensation reactor vessel were 715.0 g of dimethyl terephthalate, 95.8 g of sodium dimethyl-5-sulfoisophthalate, 526.0 g of propanediol, 48.0 g of diethylene glycol, 247.1 g of dipropylene glycol, and 1.5 g of a hydroxyl butyl tin catalyst. The resulting mixture was heated to 190° C. While collecting methanol by-products employing a distillation receiver, temperature was gradually raised to about 200—about 202° C. Subsequently, over a period of about 4.5 hours, the pressure was lowered from atmospheric pressure to 1,067 Pa, while the temperature was raised to about 210° C. The products were then collected, whereby "Polyester Resin B" at a glass transition temperature of 53.8° C. was prepared.

(Preparation of Polyester Resin Dispersion)

Subsequently, 168 g of aforesaid "Polyester Resin B" was added to 1,232 g of deionized water. The resulting mixture was stirred at 98° C. for two hours, whereby "Polyester Resin Dispersion" was prepared.

(Coalescence Process)

Added to a reactor vessel were 1,400 g of "Polyester Resin Dispersion" and 14.22 g of carbon black and the resulting mixture was dispersed. Subsequently, a 5 weight percent zinc acetate solution was prepared by dissolving zinc acetate in deionized water. The resulting solution was fed to a storage vessel placed on a balance which was connected to a pump capable of accurately supplying the zinc acetate solution at a rate of 0.01–9.9 ml/minute. The amount of zinc acetate necessary for coalescence was 10 percent with respect to the resin amount in the dispersion.

After heating the dispersion to 56° C., the zinc acetate solution was fed at a rate of 9.9 ml/minute to initiate coalescence. When 60 weight percent (equivalent to 205 g of a 5 weight percent solution) of total zinc acetate was added, the feed rate of the pump was decreased to 1.1 ml/minute, and addition was continued until the amount of zinc acetate became equal to 10 weight percent (equivalent to 335 g of a 5 weight percent solution), and the resulting mixture was stirred at 80° C. for 9 hours.

Thereafter, solid-liquid separation was carried out employing a basket type centrifuge "MARK III Model No. 60×40" (manufactured by Matsumoto Kikai Mfg. Co., Ltd.), whereby a colored particle cake was formed. The aforesaid colored particle cake was washed with water in the aforesaid basket type centrifuge and then transferred to a "Flash Jet Dryer" (manufactured by Seishin Kikaku Co., Ltd.), and dried to reach a moisture content of 0.5 percent by weight, whereby colored particles were prepared. Further, Toners 2–7were prepared in the same manner as Toner 1, except that Metal Oxide Particles 1 were respectively replaced with Metal Oxide Particles 2 –7.

<<Production of Comparative Toner 1>>

Comparative Toner 1 was prepared in the same manner as Toner 1, except that Metal Oxide Particles 1 were replaced with Comparative Metal Oxide Particles 1 (also referred to as Comparative 1).

<<Production of Comparative Toner 2>>

Comparative Toner 2 was prepared in the same manner as Toner 2, except that Metal Oxide Particles 2 were replaced with Comparative Metal Oxide Particles 2 (also referred to as Comparative 2).

Table 3 shows the physical properties of the resulting toners.

TABLE 3

| Toner | Metal Oxide Particles | Ratio of Particles without Corners (% by number) | Variation Coefficient of Particle Size Distribution (%) | Remarks |
|---|---|---|---|---|
| 1 | Metal Oxide Particles 1 | 72.1 | 18.6 | Present Invention |
| 2 | Metal Oxide Particles 2 | 72.1 | 18.6 | Present Invention |
| 3 | Metal Oxide Particles 3 | 72.1 | 18.6 | Present Invention |
| 4 | Metal Oxide Particles 4 | 62.1 | 23.4 | Present Invention |
| 5 | Metal Oxide Particles 5 | 62.1 | 23.4 | Present Invention |
| 6 | Metal Oxide Particles 6 | 48.2 | 26.3 | Present Invention |
| 7 | Metal Oxide Particles 7 | 48.2 | 26.3 | Present Invention |
| Comparative 1 | Comparative Metal Oxide Particles 1 | 72.1 | 18.6 | Comparative Example |
| Comparative 2 | Comparative Metal Oxide Particles 1 | 72.1 | 18.6 | Comparative Example |

Each of the resulting Electrostatic Image Developing Toners 1–7 and Comparative Toners 1 and 2 were evaluated as described below.

For the evaluation, a commercially available color printer C-1616 (manufactured by Fuji Xerox Co., Ltd.), utilizing an electrophotographic system, was subjected to modification of the photoreceptor diameter to 20 ϕmm. Evaluation was carried out while removing the cleaning brush of the photoreceptor as well as the cleaning mechanism of the intermediate transfer body. The above-mentioned toners were employed in development units for four colors. In order to clearly evaluate the performance of developing agents, modifications were carried out so that the same developing agent could be set, and images were then evaluated.

<<Increase in Charge Amount at Low Temperature and Low Humidity>>

At low temperature and low humidity (10° C. and 20 percent RH), initial 50,000 sheets were printed and the charge amount as well as the image density was measured. The developing agent in each of the four development units was sampled and the charge amount was determined employing a suction type charge amount meter. Image density was measured employing a Macbeth Densitometer and was represented as relative density while the density of the non-image portion was set to be 0. Subsequently, rank evaluation was carried out as described below.

A: during the initial 50,000 prints, the variation of the charge amount was less than 3.0 μC/g, and the decrease in image density was less than 0.01 (considered to be excellent)

B: during initial 50,000 prints, the variation of the charge amount was 3.0–6.0 μC/g, and the decrease in image density was less than 0.04 (considered to be good)

C: during initial 50,000 prints, the variation of the charge amount was more than 6.0 μC/g, and the decrease in image density was more than 0.04 (considered to be poor)

<<Transfer Repellency at Low Temperature and Low Humidity>>

Thirty-two 200 g paper sheets available from Rank Xerox Co. were continually printed at low temperature and low humidity (10° C. and 20 percent RH). A halftone image which resulted in a relative density of 0.2–0.3 was printed, and the generation of spots due to discharge at the bottom edge of the image was inspected.

A: no spots due to discharge were detected in any of the Sheets (being an excellent rating)

B: spots which were detected through attentive observation were detected on 1–2 sheets (being a good rating)

C: definite spots were generated on at least 3 sheets (being a poor rating)

<<Release of External Additives>>

The carrier surface was observed at a magnification of 40,000 employing an electric field effect scanning type electron microscope.

A: almost no external additives released from the toner were adhered

B: 2–10 external additives released from the toner were present in a 1 $\mu m^2$ area, but charging was not hindered resulting in no problem for commercial viability C: at least 11 external additives released from the toner Were present in 1 $\mu m^2$ area and the charge amount tended to decrease by 4–10 μC/g weight part compared to the initial value D: at least 30 external additives released from the toner were present in 1 $\mu m^2$ area and the charge amount decreased by at least 10 μC/g weight part compared to the initial value, and toner scattering and in addition, background stain were generated <<Lifetime of Developing Agent>>

With respect to the manufacturer's specification of 30,000 prints, at every 30,000, tested developing agent was placed one by one into other cartridges, and the durability test was continued.

A: it was possible to use for a total of at least 600,000 prints (considered to be excellent)

B: the lifetime was for a total of 300,000–600,000 prints (considered to be good)

C: the lifetime was for a total of 60,000–300,000 prints (considered to be commercially viable)

D: the lifetime was for a total of 30,000–60,000 prints (considered to be poor)

<<Adaptability to Cleanerless Process>>

The rank evaluation described below was carried out within 30,000 prints specified by the manufacturer.

A: neither toner stain on the charging roller nor white streaking due to toner stain on the transfer roller was noted, and further no fine lines printed just previously appeared in the following image (considered to be excellent)

B: neither toner stain on the charging roller nor white streaking due to toner stain on the transfer roller was noted, and further, fine lines printed just previously appeared in the following image at rare intervals and was noted only after careful observation, resulting in no problems for commercial viability (considered to be good)

C: toner stain on the charging roller as well as white streaking due to toner stain on the transfer roller was noted, and further, fine lines printed just previously were clearly noted in the following image (considered to be poor)

<<Storage Stability>>

Placed in a glass sample tube was 1 g of each toner and was allowed to stand in a thermostat maintained at 50° C. and 90 percent RH for 48 hours. Thereafter, the resulting toner was sieved employing a 28-mesh test sieve and toner granules remaining in the sieve were weighed. The storage stability was evaluated based on the ratio of generated granules.

A: the generation of granules was less than 10 present (considered to be excellent)

B: the generation of granules was 10–30 percent (considered to be good)

C: the generation of granules was at least 30 percent (considered to be no commercially viable)

Table 4 shows the results.

TABLE 4

| Toner | Metal Oxide Particles | Increase in Charge Amount at Low Temperature and Low Humidity | Transfer Repellency at Low Temperature and Low Humidity | Releasing of External Additive | Lifetime of Developing Agent | Adaptability to Cleanerless Process | Storage Stability | Remarks |
|---|---|---|---|---|---|---|---|---|
| 1 | 1 | A | A | A | A | A | A | Inv. |
| 2 | 2 | A | B | A | A | A | A | Inv. |
| 3 | 3 | A | B | A | A | A | A | Inv. |
| 4 | 4 | A | A | B | A | B | A | Inv. |
| 5 | 5 | A | A | B | A | B | A | Inv. |
| 6 | 6 | B | B | B | B | B | A | Inv. |
| 7 | 7 | B | B | B | B | B | A | Inv. |
| Comparative 1 | Comparative 1 | C | C | B | B | C | B | Comp. |
| Comparative 2 | Comparative 2 | B | B | D | D | C | B | Comp. |

Inv.; Present Invention
Comp.; Comparative Example

Based on Table 4, it can be seen that, compared to comparative toners, toners of the present invention minimized an increase in charge amount at low temperature and low humidity, effectively minimized transfer repellency at low temperature and low humidity, resulted in a long lifetime of the developing agents, exhibited adaptability to the cleanerless process as well as excellent storage stability.

It was possible to provide an electrostatic image developing toner, a two-component developing agent, an image forming method, and an electrophotographic image forming apparatus which resulted in high transferability, high adaptability for a cleaner process, no abrasion on the receptor surface (resulting in no white spots), no staining on the carrier, the development roller, and the charging unit, and no generation of toner blisters.

The invention claimed is:

1. A toner for developing an electrostatic image comprising toner particles and metal oxide particles, wherein the toner particles comprises a first resin and a colorant, and the metal oxide particles have a domain-matrix structure comprising more than one domain in a matrix.

2. The toner of claim 1, wherein more than one domain comprises titanium oxide and the matrix comprises silica.

3. The toner of claim 1, wherein more than one domain comprises zirconium oxide or aluminum oxide and the matrix comprises silica.

4. The toner of claim 1, wherein more than one domain and the metal oxide particles are substantially spherical.

5. The toner of claim 1, wherein a ratio (B/A) is 0.05–0.4, wherein A is a number-based average diameter of primary particles of the metal oxide particles and B is a number-based average diameter of more than one domain.

6. The toner of claim 1, wherein a number average diameter of primary particles of the metal oxide particles is 20–300 nm and a number average FERE horizontal diameter of more than one domain is 1–60 nm.

7. The toner of claim 1, wherein a ratio (Y/X) is 0.1–0.6, wherein X is a weight of the metal oxide particles and Y is a weight of more than one domain.

8. The toner of claim 1, wherein a moisture content of the metal oxide particles is at most 2 percent by weight.

9. The toner of claim 1, wherein a ratio of toner particles without corners is at least 50 percent by number based on the toner particles and a number variation coefficient of a number particle size distribution is at most 27 percent.

10. The toner of claim 1, wherein the toner particles have a covering layer comprising a second resin whose composition is different from the composition of the first resin.

11. The toner of claim 1, wherein a surface of the toner particle is modified with a third resin whose composition is different from a composition of the first resin.

12. A two-component developing agent comprising the toner of claim 1 and carrier.

13. The toner of claim 1 wherein a ratio (B/A) is 0.02–0.41, wherein A is number-based average diameter of primary particles of the metal oxide particles and B is a number-based average diameter of more than one domain.

14. The toner of claim 13, wherein a ratio (B/A) is 0.06–0.2.

15. The toner of claim 4, wherein a ratio (B/A) is 0.05–0.4, wherein A is a number-based average diameter of primary particles of the metal oxide particles and B is a number-based average diameter of more than one domain; and a number-average diameter of primary particles of primary particles of the metal oxide particles is 20–300 nm and a number average FERE horizontal diameter of the domain is 1–60 nm.

16. The toner of claim 1, wherein the metal oxide particles are an external additive.

* * * * *